US009299286B2

(12) United States Patent
Omoto

(10) Patent No.: US 9,299,286 B2
(45) Date of Patent: Mar. 29, 2016

(54) DISPLAY DEVICE AND ELECTRONIC APPLIANCE

(75) Inventor: Keisuke Omoto, Tokyo (JP)

(73) Assignee: JOLED INC., Tokyo (JP)

( * ) Notice: Subject to any disclaimer, the term of this patent is extended or adjusted under 35 U.S.C. 154(b) by 1086 days.

(21) Appl. No.: 13/048,433

(22) Filed: Mar. 15, 2011

(65) Prior Publication Data

US 2011/0234553 A1 Sep. 29, 2011

(30) Foreign Application Priority Data

Mar. 29, 2010 (JP) ..... 2010-075059

(51) Int. Cl.
*G09G 3/32* (2006.01)

(52) U.S. Cl.
CPC ..... *G09G 3/3233* (2013.01); *G09G 2300/0866* (2013.01)

(58) Field of Classification Search
CPC ..... H01L 27/124; H01L 29/78633; H01L 29/78645; H01L 29/78648; G09G 3/3233; G09G 2300/0866
USPC ..... 345/92, 204–206; 257/59, 72; 313/169, 313/483; 349/46, 42
See application file for complete search history.

(56) References Cited

U.S. PATENT DOCUMENTS

2002/0163049 A1* 11/2002 Yamazaki et al. ..... 257/408
2004/0188755 A1* 9/2004 Tarui et al. ..... 257/328
2005/0059219 A1* 3/2005 Tayanaka ..... 438/458
2006/0192205 A1* 8/2006 Yamazaki et al. ..... 257/72
2006/0290633 A1* 12/2006 Choi ..... 345/92
2008/0111195 A1* 5/2008 Atanackovic ..... 257/366
2008/0128705 A1* 6/2008 Ishiguro ..... 257/72
2008/0246403 A1* 10/2008 Sagawa et al. ..... 315/35
2010/0084653 A1* 4/2010 Yamazaki et al. ..... 257/43

FOREIGN PATENT DOCUMENTS

JP 2003-051384 2/2003
JP 2003-308030 10/2003
JP 2005-157264 6/2005
JP 2007-005766 1/2007
JP 2008-175945 7/2008
JP 2008-310127 12/2008
JP 2009-014933 1/2009

(Continued)

OTHER PUBLICATIONS

Japanese Office Action issued in connection with related Japanese Application No. 2010-075059 dated Aug. 20, 2013.

*Primary Examiner* — Lun-Yi Lao
*Assistant Examiner* — Ibrahim Khan
(74) *Attorney, Agent, or Firm* — Dentons US LLP

(57) ABSTRACT

A display device includes: a plurality of arranged pixels, each of which includes an electro-optical component, a write-in transistor writing an image signal in a pixel, a maintenance capacity maintaining the image signal written by the write-in transistor, and a driving transistor driving the electro-optical component based on the image signal maintained by the maintenance capacity, wherein the write-in transistor has a plurality of gates, the gate of the driving transistor side among the plurality of gates has a structure in which a channel region is sandwiched between a first gate electrode and a second gate electrode, and the width of the channel region of the gate of the driving transistor side is narrower than the width of the channel region of other gates.

8 Claims, 22 Drawing Sheets

(56) References Cited

FOREIGN PATENT DOCUMENTS

| | | |
|---|---|---|
| JP | 2009-037100 | 2/2009 |
| JP | 2009-047765 | 3/2009 |
| JP | 2009-244526 | 10/2009 |
| JP | 2010-039397 | 2/2010 |

* cited by examiner

BEFORE $t=t_{11}$ $t=t_{11}$ $t=t_{12}$ $t=t_{13}$

THRESHOLD VALUE CORRECTION: NO, MOBILITY CORRECTION: NO

THRESHOLD VALUE CORRECTION: YES, MOBILITY CORRECTION: NO

THRESHOLD VALUE CORRECTION: YES, MOBILITY CORRECTION: YES

IF IT IS ASSUMED THAT $V_g$, $V_s$ BEFORE BOOTSTRAP ARE $V_{g1}$, $V_{s1}$, AND $V_g$, $V_s$ AFTER BOOTSTRAP ARE $V_{g2}$, $V_{s2}$, $$(C_{gd}+C_{ws})(V_{g1}-V_{g2})+(C_s+C_{gs})\{(V_{g1}-V_{s1})-(V_{g2}-V_{s1})\}=0$$

$$(C_{gd}+C_{ws}+C_s+C_{gs})(V_{g2}-V_{g1})=(C_s+C_{gs})(V_{s2}-V_{s1})$$

$$\therefore V_{g2}-V_{g1}=G_b(V_{s2}-V_{s1})$$

$$G_b=\frac{(C_s+C_{gs})}{(C_{gd}+C_{ws}+C_s+C_{gs})}$$

$$\Delta V_{ga}=G_b\cdot\Delta V_{sa}$$

$$\Delta V_{gb}=G_b\cdot\Delta V_{sb}=G_b(\Delta V_{sa}+V_{oled2}-V_{oled1})$$

$$V_{gsa}=V_{sig}+G_b\cdot\Delta V_{sa}-V_{oled1}$$

$$V_{gsb}=V_{sig}+G_b\cdot\Delta V_{sa}-V_{oled1}-(1-G_b)(V_{oled2}-V_{oled1})$$

$G_B$
$G_A$
$233_B$
$233_A$
$232_B$
$232_A$
$231_B$
$231_A$
23A
234
235
SIDE OF DRIVING TRANSISTOR 22
SIDE OF SIGNAL LINE 33

$G_B$
$G_A$
$233_B$
$232_B$
$231_B$
$233_A$
$232_A$
$231_A$
234
235
236
23B
$W_B$
$W_A$
$L_1$
$L_2$
SIDE OF DRIVING TRANSISTOR 22
SIDE OF SIGNAL LINE 33

FIG.22A
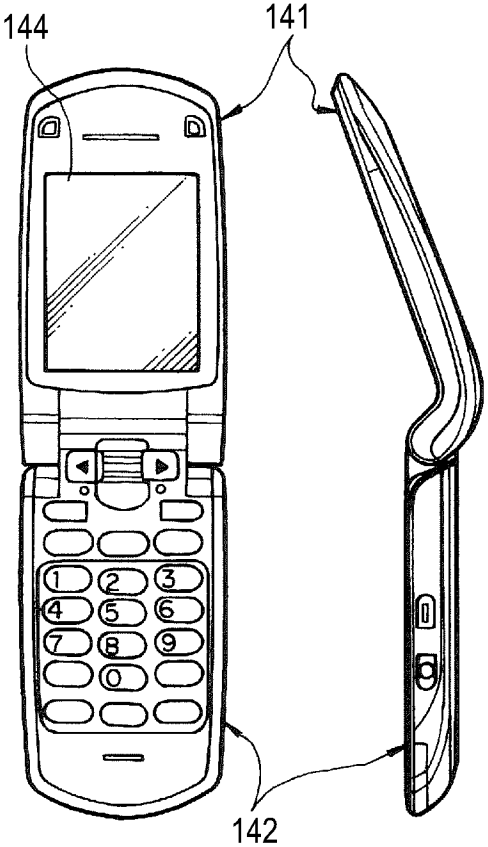
FIG.22B
FIG.22C
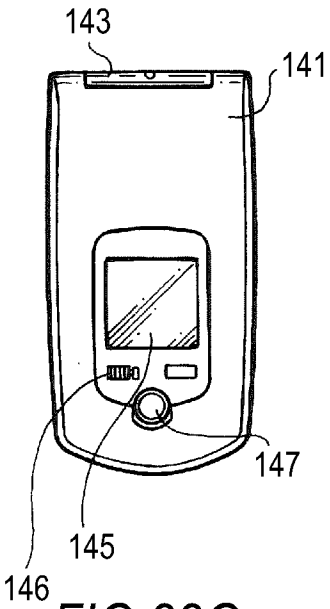
FIG.22D
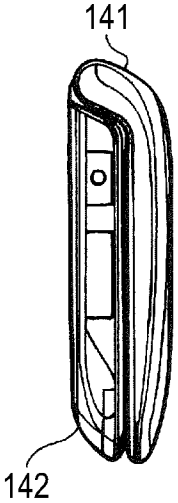
FIG.22E
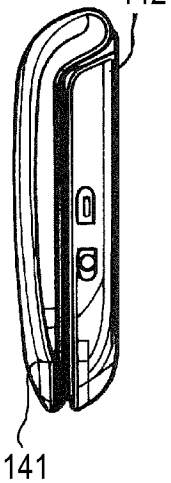
FIG.22F
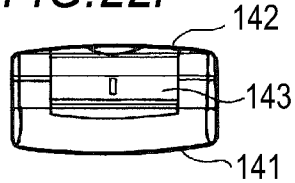
FIG.22G
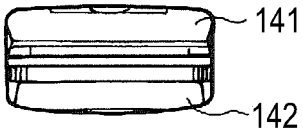

DISPLAY DEVICE AND ELECTRONIC APPLIANCE

BACKGROUND OF THE INVENTION

1. Field of Invention

The invention relates to a display device and an electronic appliance, and more particularly to a display device in which pixels including electro-optical components are two-dimensionally (2D) arranged in the form of a matrix and an electronic appliance having the display device.

2. Description of the Related Art

Recently, in the field of display devices that perform image display, plane-type (flat panel type) display devices in which pixels (pixel circuits) are arranged in the form of a matrix have been rapidly spread. As a kind of plane type display device, there is a display device that uses a so-called current driving type electro-optical component, in which luminance is changed according to a current value that flows in the device, as a light-emitting device of a pixel. As a current driving type electro-optical component, an organic electroluminescence (EL) device is known, which has a phenomenon of emitting light when an electric field is applied to an organic thin film using EL that is an organic material.

An organic EL display device that uses organic EL devices as light-emitting devices of pixels has the following characteristics. That is, since the organic EL device can be driven by an applied voltage equal to or lower than 10V, it consumes little power. Since the organic EL device is a self-light emitting device, it has a high visual recognition of an image in comparison to a liquid crystal display, and since it does not require an illumination member such as a backlight or the like, it is easy to make it light-weight and ultra-thin. Also, since the response speed of the organic EL device is very high to the extent of several μs, no afterimage is generated when a moving image is displayed.

In the same manner as a liquid crystal display, an organic EL display device may adopt a simple (passive) matrix type and an active matrix type as its driving type. However, according to the simple matrix type display device, although it has a simple structure, the light-emitting term of the electro-optical components is decreased as the number of scanning lines (that is, the number of pixels) is increased, and thus it is difficult to realize a large-scale high-definition display device.

Because of this, the development of an active matrix type display device in which current flowing through electro-optical components is controlled by active elements installed in pixels such as the electro-optical components, for example, insulated gate field effect transistors, have been actively made. As the insulated gate field effect transistor, generally, a TFT (Thin Film Transistor) is used. According to the active matrix type display device, the electro-optical components continue light emission through a period of one display frame, and thus it is easy to realize a large-scale high-definition display device.

A pixel circuit that includes a current driving type electro-optical component, which is driven by the active matrix type, is provided with a driving circuit for driving the electro-optical component in addition to the electro-optical component. A pixel circuit is known, which is configured to have an organic EL device 21 that is a current driving type electro-optical component, a driving transistor 22 as a driving circuit, a write-in transistor 23, and a maintenance capacity 24 (for example, see JP-A-2008-310127).

JP-A-2008-310127 discloses that when a gate electrode of a driving transistor 22 is in a floating state, a gate potential $V_g$ is changed in association with a source potential $V_s$ of the driving transistor 22 to perform a so-called bootstrap operation (see Paragraph No. 0071 of JP-A-2008-310127). JP-A-2008-310127 also discloses that even if the I-V characteristic of the organic EL device 21 is time-dependently changed, the gate-source voltage $V_{gs}$ of the driving transistor 22 is maintained constant, and thus light emitting luminance is maintained constant (see Paragraph No. 0093 of JP-A-2008-310127).

SUMMARY OF THE INVENTION

In the above-described bootstrap operation, the ratio ($=\Delta V_g/\Delta V_s$) of a variation $\Delta V_g$ of the gate potential $V_g$ to a variation $\Delta V_s$ of the source potential $V_s$ of the driving transistor 22 becomes a bootstrap gain $G_b$. This bootstrap gain $G_b$ is determined by a capacitance value of the maintenance capacity 24 and a capacitance value of parasitic capacitance that is parasitic on the gate electrode of the driving transistor 22.

On the other hand, parasitic capacitance exists also in the write-in transistor 23. The parasitic capacitance of the write-in transistor 23 corresponds to one parasitic capacitance that is parasitic on the gate electrode of the driving transistor 22. Accordingly, under the influence of the parasitic capacitance that exists in the write-in transistor 23, the bootstrap gain $G_b$ is changed from an ideal state ($G_b=1$). Specifically, the bootstrap gain $G_b$ deteriorates.

If the bootstrap gain $G_b$ deteriorates, the light emitting state is not maintained with respect to the gate-source voltage $V_{gs}$ of the driving transistor 22 in a state where a difference $\Delta V_{th}$ in threshold voltage $V_{th}$ between pixels is maintained, dispersion in luminance occurs between the pixels (the details thereof will be described later). The dispersion in luminance between pixels is visually recognized as a vertical stripe, a horizontal stripe, or luminance non-uniformity. As a result, the uniformity of a screen is damaged.

Accordingly, it is desirable to provide a display device which can improve the bootstrap gain by reducing the capacitance value of the parasitic capacitance of the write-in transistor and obtain a good-quality display image without damaging the uniformity of the screen, and an electronic appliance having the display device.

According to an embodiment of the invention, there is provided a display device including: a plurality of arranged pixels, each of which includes an electro-optical component, a write-in transistor writing an image signal in a pixel, a maintenance capacity maintaining the image signal written by the write-in transistor, and a driving transistor driving the electro-optical component based on the image signal maintained by the maintenance capacity; wherein the write-in transistor has a plurality of gates, the gate of the driving transistor side among the plurality of gates has a structure in which a channel region is sandwiched between a first gate electrode and a second gate electrode, and the width of the channel region of the gate of the driving transistor side is narrower than the width of the channel region of other gates.

In the display device having the above-described configuration, the write-in transistor has a structure in which the plurality of gates are provided, for example, a double-gate structure. According to this double-gate structure, leak currents between a source region and a drain region can be reduced. Also, the write-in transistor has a sandwich structure, in which the second gate electrode is provided as a back gate electrode and the channel region is sandwiched between two gate electrodes (first and second gate electrodes), with respect to the gate of the driving transistor side. According to this sandwich structure, for example, the transistor characteristic can be improved in comparison to a bottom gate structure. In the write-in transistor, the width of the channel region of the gate of the driving transistor side is set to be narrower than the width of the channel region of other gates.

Here, between the second gate electrode that is the back gate electrode and the channel region, parasitic capacitance is formed, which has a capacitance value according to the opposite region between the second gate electrode and the channel region. In this case, in the gate of the driving transistor side, the width of the channel region is narrower than the width of the channel region of other gates, and thus the capacitance value of the parasitic capacitance becomes smaller than the capacitance value of the parasitic capacitance formed in other gates. The parasitic capacitance of the write-in transistor, particularly, the parasitic capacitance of the gate of the driving transistor side, becomes one parameter that determines the bootstrap gain. Accordingly, the capacitance value of the parasitic capacitance can be reduced, and thus the bootstrap gain can be improved.

According to the embodiment of the invention, since the bootstrap gain is improved by reducing the capacitance value of the parasitic capacitance of the write-in transistor, a good-quality display image can be obtained without damaging the uniformity of the screen.

BRIEF DESCRIPTION OF THE DRAWINGS

FIGS. 15A and 15B are diagrams illustrating the structure of a write-in transistor in the related art, in which FIG. 15A is a plane pattern diagram, and FIG. 15B is a cross-sectional diagram;

FIGS. 16A and 16B are diagrams illustrating the structure of a write-in transistor according to an embodiment of the invention, in which FIG. 16A is a plane pattern diagram, and FIG. 16B is a cross-sectional diagram;

FIGS. 19A and 19B are perspective diagrams illustrating an external appearance of a digital camera to which the invention is applied, in which FIG. 19A is a perspective diagram as seen from the surface side, and FIG. 19B is a perspective diagram as seen from the rear surface side;

FIGS. 22A to 22G are diagrams illustrating external appearances of a portable phone to which the invention is applied, in which FIG. 22A is a front diagram of a portable phone in an open state, FIG. 22B is a side diagram thereof, FIG. 22C is a front diagram of a portable phone in a closed state, FIG. 22D is a left side diagram thereof, FIG. 22E is aright side diagram thereof, FIG. 22F is a plan diagram thereof, and FIG. 22G is a bottom diagram thereof.

DESCRIPTION OF THE PREFERRED EMBODIMENTS

Hereinafter, modes for carrying out the invention (hereinafter referred to "embodiments") will be described with reference to the accompanying drawings. In this case, the explanation will be made in the following order.

1. Organic EL display device to which the invention is applied
   1-1. System configuration
   1-2. Basic circuit operation
   1-3. Regarding bootstrap operation
2. Explanation of organic EL device according to embodiments
3. Modified examples
4. Electronic appliance <1. Organic EL Display Device to which the Invention is Applied>

[1-1. System Configuration]

Figure 1:
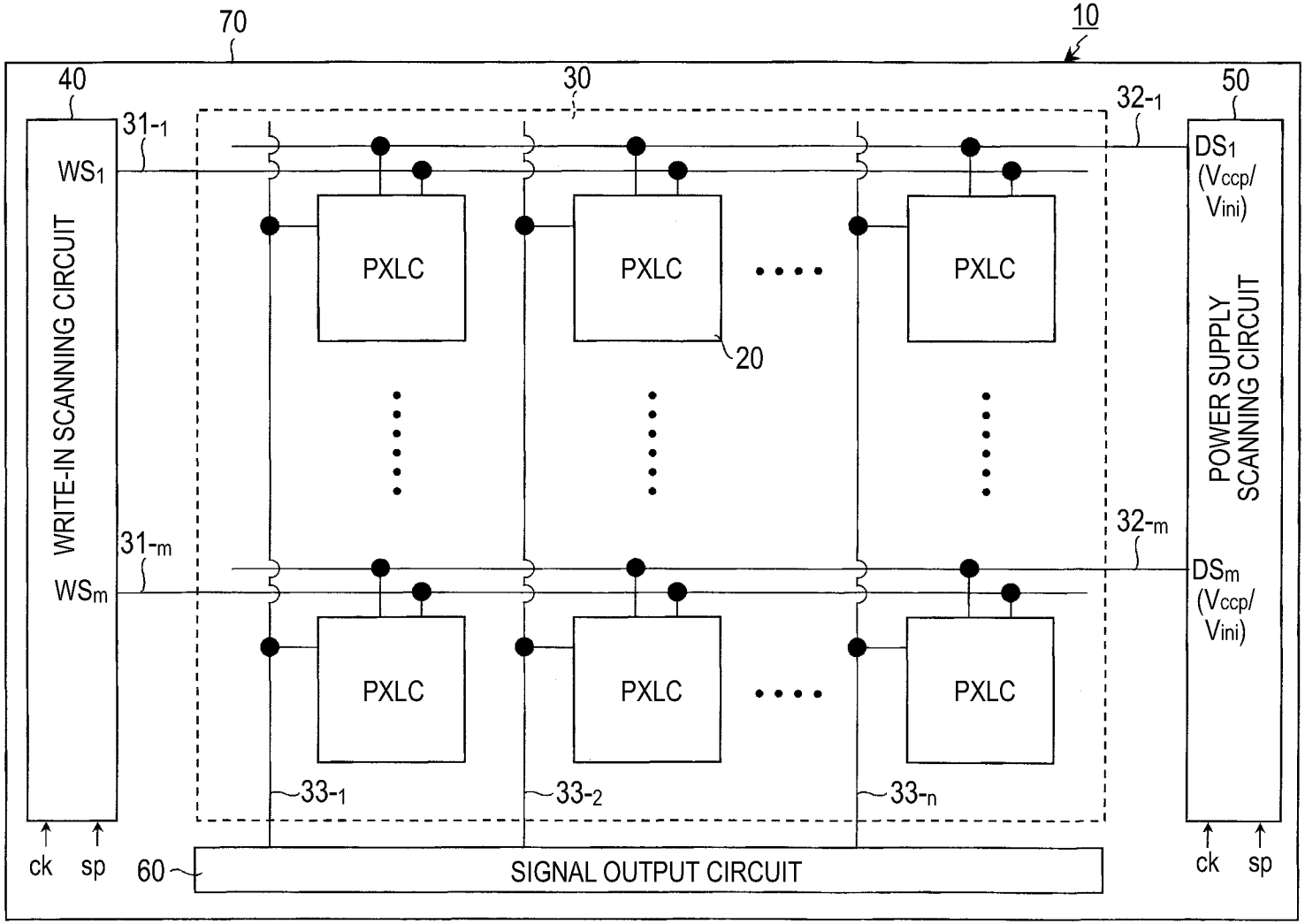
FIG. 1 is a system configuration diagram briefly illustrating the configuration of an organic EL display device to which the invention is applied.

FIG. 1 is a system configuration diagram briefly illustrating the configuration of an active matrix type display device to which the invention is applied.

An active matrix type display device is a display device that controls the current flowing through electro-optical components by active elements installed in pixels such as the electro-optical components, for example, insulated gate field effect transistors. As the insulated gate field effect transistor, generally, a TFT (Thin Film Transistor) is used.

Here, as an example, a current drive type electro-optical component, in which luminance is changed according to a current value flowing through the device, for example, an active matrix type organic EL display device that uses organic EL devices as light-emitting devices of pixels (pixel circuits), will be described.

As illustrated in FIG. 1, an organic EL display device 10 according to this application includes a plurality of pixels 20 including organic EL devices, a pixel array unit 30 in which the pixels 20 are two-dimensionally (2D) arranged in the form of a matrix, and a driving unit arranged in the neighborhood of the pixel array unit 30. The driving unit includes a write-in scanning circuit 40, a power supply scanning circuit 50, and a signal output circuit 60, and drives the respective pixels 20 of the pixel array unit 30.

Here, in the case where the organic EL display device 10 corresponds to a color display, one pixel is composed of a plurality of sub-pixels, and the sub-pixels constitute a pixel 20. More specifically, in a color display device, one pixel is composed of three sub-pixels, that is, a sub-pixel that emits a red light (R), a sub-pixel that emits a green light (G), and a sub-pixel that emits a blue light (B).

However, one pixel is not limited to a combination of sub-pixels for the three primary colors of RGB, and it is also possible to configure one pixel through the addition of sub-pixel(s) for one color or a plurality of colors to the sub-pixels for three primary colors. More specifically, for example, one pixel may be configured by adding a sub-pixel that emits a white light (W) to improve the luminance to the sub-pixels for three primary colors or by adding at least one sub-pixel that emits a complementary color light to extend the color reproduction range to the sub-pixels for three primary colors.

In the pixel array unit 30, with respect to an arrangement of pixels 20 with m rows and n columns, scanning lines $\mathbf{31}_{-1}$ to $\mathbf{31}_{-m}$ and power supply lines $\mathbf{32}_{-1}$ to $\mathbf{32}_{-m}$ are wired for each pixel row along the row direction (pixel arrangement direction of a pixel row). Also, signal lines $\mathbf{33}_{-1}$ to $\mathbf{33}_{-n}$ are wired for each pixel row along the column direction (pixel arrangement direction of a pixel column).

The scanning lines $\mathbf{31}_{-1}$ to $\mathbf{31}_{-m}$ are respectively connected to output terminals of the rows that correspond to the write-in scanning circuit 40. The power supply lines $\mathbf{32}_{-1}$ to $\mathbf{32}_{-m}$ are respectively connected to output terminals of the columns that correspond to the power supply scanning circuit 50. The signal lines $\mathbf{33}_{-1}$ to $\mathbf{33}_{-n}$ are connected to output terminals of the columns that correspond to the signal output circuit 60.

The pixel array unit 30 is typically formed on a transparent insulating substrate such as a glass substrate or the like. Accordingly, the organic EL display device 10 has a plane type (flat type) panel structure. The driving circuit of the respective pixels 20 of the pixel array unit 30 may be formed using amorphous silicon TFTs or low-temperature polysilicon TFTs. In the case of using the low-temperature polysilicon TFTs, as illustrated in FIG. 1, the write-in scanning circuit 40, the power supply scanning circuit 50, and the signal output circuit 60 can also be mounted on the display panel (substrate) 70 that forms the pixel array unit 30.

The write-in scanning circuit 40 includes a shift register that shifts (transmits) a start pulse sp in order in synchronization with a clock pulse ck. In writing an image signal in the respective pixels 20 of the pixel array unit 30, the write-in scanning circuit 40 scans in order (progressively scans) the respective pixels 20 of the pixel array unit 30 in the unit of a row by progressively supplying the write scan signal WS ($WS_1$ to $WS_m$) with respect to the scanning lines $\mathbf{31}_{-1}$ to $\mathbf{31}_{-m}$.

The power supply scanning circuit 50 includes a shift register that shifts a start pulse sp in order in synchronization with a clock pulse ck. In synchronization with the progressive scanning by the write-in scanning circuit 40, the power supply scanning circuit 50 supplies the power supply potential DS ($DS_1$ to $DS_m$), which can be switched between a first power supply potential $V_{ccp}$ and a second power supply potential $V_{ini}$ that is lower than the first power supply potential $V_{ccp}$, to the power supply lines $\mathbf{32}_{-1}$ to $\mathbf{32}_{-m}$. As described later, by switching $V_{ccp}/V_{ini}$ of the power supply potential DS, the control of light emission/non-light emission of the pixels 20 is performed.

The signal output circuit 60 selectively outputs a signal voltage $V_{sig}$ of an image signal according to luminance information that is supplied from a signal supply source (not illustrated) (hereinafter may be simply referred to as "signal voltage") and a reference voltage $V_{ofs}$. Here, the reference voltage $V_{ofs}$ is a voltage that becomes a reference against the signal voltage $V_{sig}$ of the image signal (for example, a voltage that corresponds to the black level of the image signal), and is used to perform correction of the threshold value to be described later.

The signal voltage $V_{sig}$ output from the signal output circuit 60/the reference voltage $V_{ofs}$ is written in the unit of a pixel row that is selected by scanning through the write-in scanning circuit 40, with respect to the respective pixels 20 of the pixel array unit 30 through the signal lines $\mathbf{33}_{-1}$ to $\mathbf{33}_{-n}$. That is, the signal output circuit 60 adopts a line-sequential writing driving type that writes the signal voltage $V_{sig}$ in the unit of a row (line).

(Pixel Circuit)

Figure 2:
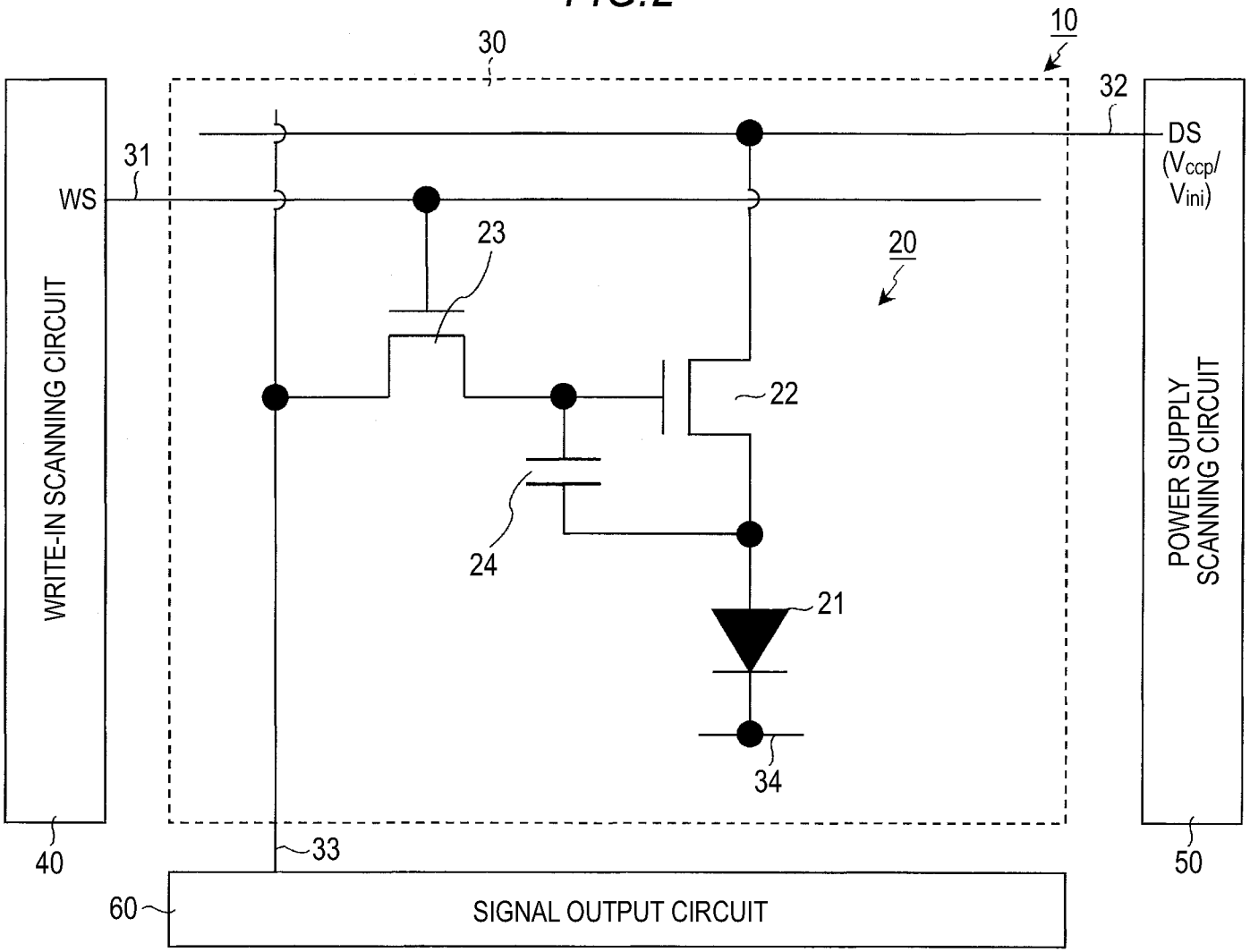
FIG. 2 is a circuit diagram illustrating an example of a circuit configuration of a pixel of an organic EL display device to which the invention is applied.

FIG. 2 is a circuit diagram illustrating an example of a circuit configuration of a pixel (pixel circuit) 20.

As illustrated in FIG. 2, the pixel 20 is composed of an organic EL device 21 that is a current drive type electro-optical component, in which luminance is changed according to a current value flowing through the device, and a driving circuit driving the organic EL device 21 by flowing a current to the organic EL device 21. The cathode electrode of the organic EL device 21 is connected to a common power supply line 34 that is commonly wired (so-called solid-wired) with respect to all the pixels 20.

The driving circuit that drives the organic EL device 21 is composed of a driving transistor 22, a write-in transistor 23, and a maintenance capacity 24. As the driving transistor 22 and the write-in transistor 23, N-channel TFTs may be used. However, a conduction type combination of the driving transistor 22 and the write-in transistor 23 as described herein is merely exemplary, and the driving circuit is not limited to such a combination.

If the N-channel TFTs are used as the driving transistor 22 and the write-in transistor 23, they may be formed using an amorphous silicon (a-Si) process. By using the a-Si process, it becomes possible to provide a substrate for making the TFTs at a low cost, and further to provide the organic EL display device 10 at a low cost. Also, if the driving transistor 22 and the write-in transistor 23 are provided as a combination of the same conduction type, both the transistors 22 and 23 can be made in the same process, and thus this can contribute to the low-cost of the transistors.

One electrode (source/drain electrode) of the driving transistor 22 is connected to the anode electrode of the organic EL device 21, and the other electrode (drain/source electrode) thereof is connected to the power supply line 32 ($\mathbf{32}_{-1}$ to $\mathbf{32}_{-m}$).

One electrode (source/drain electrode) of the write-in transistor 23 is connected to the signal line 33 ($\mathbf{33}_{-1}$ to $\mathbf{33}_{-n}$), and the other electrode (drain/source electrode) thereof is connected to the gate electrode of the driving transistor 22. Also, the gate electrode of the write-in transistor 23 is connected to the scanning line 31 ($\mathbf{31}_{-1}$ to $\mathbf{31}_{-m}$).

In the driving transistor 22 and the write-in transistor 23, one electrode means a metal wire that is electrically connected to the source/drain region, and the other electrode means a metal wire that is electrically connected to the drain/source region. Also, if one electrode becomes a source electrode by the potential relationship between one electrode and the other electrode, the other electrode becomes a drain electrode, while if one electrode becomes a drain electrode, the other electrode becomes a source electrode.

One electrode of the maintenance capacity 24 is connected to the gate electrode of the driving transistor 22, and the other electrode thereof is connected to the other electrode of the driving transistor 22 and the anode electrode of the organic EL device 21.

In this case, the driving circuit of the organic EL device 21 is not limited to the circuit configuration that is composed of two transistors, that is, the driving transistor 22 and the write-in transistor 23, and one capacitance device, that is, the maintenance capacity 24. For example, as one electrode is connected to the anode electrode of the organic EL device 21 and the other electrode is connected to a fixed potential, it becomes possible to adopt a circuit configuration in which a supplementary capacitance that supplements the capacitance shortfall of the organic EL device 21 is installed if necessary.

In the pixel 20 having the above-described configuration, the write-in transistor 23 is in a conductive state in response to a high (active) write-in scanning signal WS that is applied from the write-in scanning circuit 40 to the gate electrode through the scanning line 31. Accordingly, the write-in transistor 23 samples the signal voltage $V_{sig}$ of the image signal according to the luminance information or the reference voltage $V_{ofs}$, which is supplied from the signal output circuit 60 through the signal line 33, and writes the sampled voltage in the pixel 20. This written signal voltage $V_{sig}$ or the reference voltage $V_{ofs}$ is applied to the gate electrode of the driving transistor 22 and is maintained in the maintenance capacity 24.

When the potential DS of the power supply line 32 (32$_{-1}$ to 32$_{-m}$) reaches the first power supply potential $V_{ccp}$, one electrode of the driving transistor 22 becomes a drain electrode and the other electrode thereof becomes a source electrode, and thus the driving transistor 22 operates in a saturation region. Accordingly, the driving transistor 22 receives a current supply from the power supply line 32 and current-drives the organic EL device 21 to emit light. More specifically, the driving transistor 22, which operates in a saturation region, supplies a drive current having a current value according to the voltage value of the signal voltage $V_{sig}$ that is maintained in the maintenance capacity 24 to the organic EL device 21, and current-drives the organic EL device 21 to emit light.

Also, when the power supply potential DS is changed from the first power supply potential $V_{ccp}$ to the second power supply potential $V_{ini}$ one electrode of the driving transistor 22 becomes the source electrode and the other electrode thereof becomes the drain electrode, and thus the driving transistor 22 operates as a switching transistor. Accordingly, the driving transistor 22 stops the supply of the drive current to the organic EL device 21 to make the organic EL device 21 in a non-light emission state. That is, the driving transistor 22 also has a function as a transistor that controls light emission/non-light emission of the organic EL device 21.

By the switching operation of the driving transistor 22, the ratio (duty) of a light emission period to a non-light emission period of the organic EL device 21 can be controlled by setting the period in which the organic EL device 21 is in a non-light emission state (non-light emission period). Since afterimage blurring according to the pixel emits light through one display frame period can be reduced by the duty control, the image quality of a moving image becomes more superior.

Of the first and second power supply potentials $V_{ccp}$ and $V_{ini}$ that are selectively supplied from the power supply scanning circuit 50 through the power supply line 32, the first power supply potential $V_{ccp}$ is a power supply potential for supplying the drive current for driving the organic EL device 21 to the driving transistor 22. Also, the second power supply potential $V_{ini}$ is a power supply potential for applying a reverse bias to the organic EL device 21. The second power supply potential $V_{ini}$ is set to a potential that is lower than the reference voltage $V_{ofs}$, for example, on the assumption that the threshold voltage of the driving transistor 22 is $V_{th}$, a potential that is lower than $V_{ofs}-V_{th}$, and preferably, a potential that is sufficiently lower than $V_{ofs}-V_{th}$.

(Pixel Structure)

Figure 3:
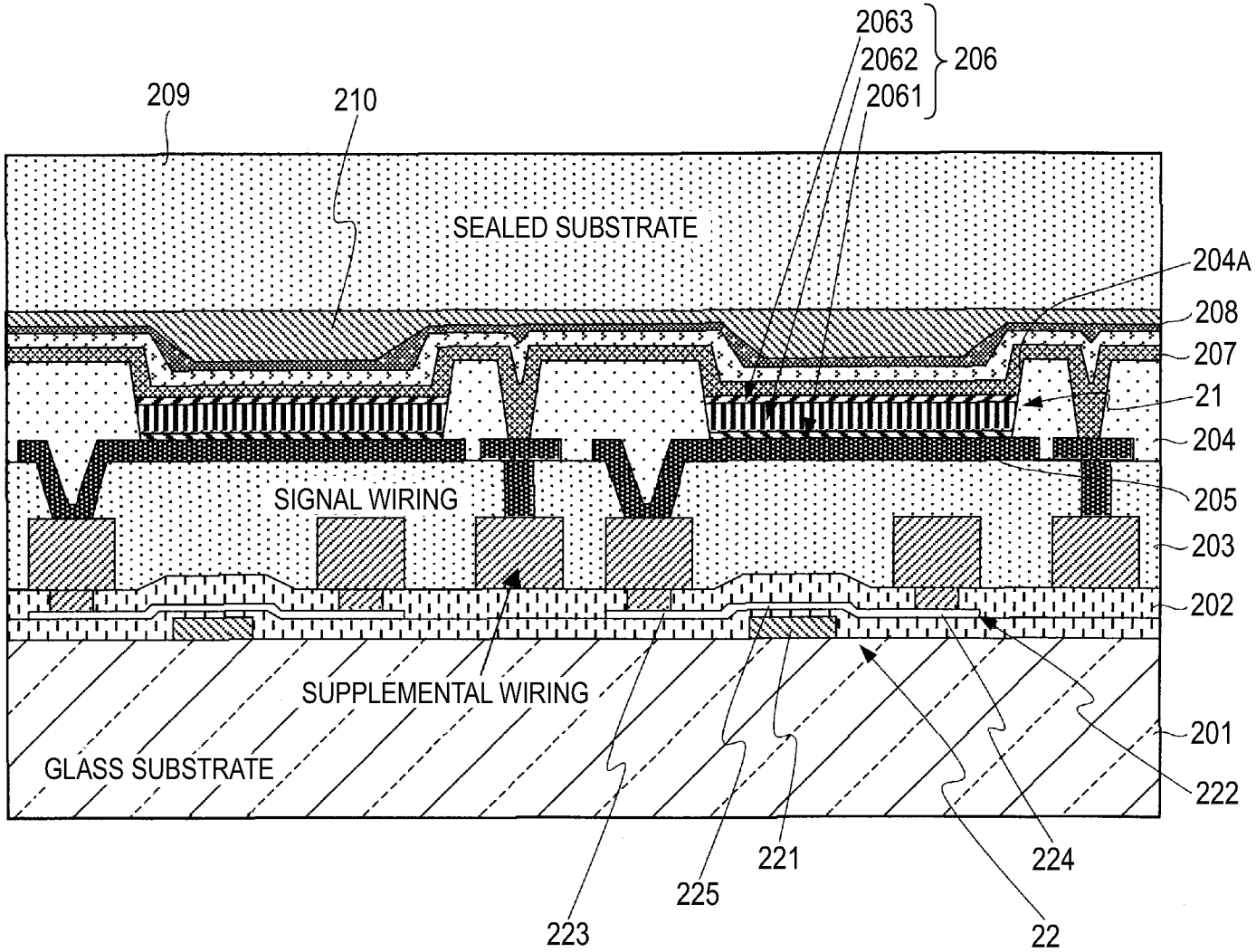
FIG. 3 is a cross-sectional diagram illustrating an example of a cross-sectional structure of a pixel.

FIG. 3 is a cross-sectional diagram illustrating an example of a cross-sectional structure of a pixel 20. As illustrated in FIG. 3, a driving circuit that includes a driving transistor 22 and the like is formed on a glass substrate 201. Also, the pixel 20 has a configuration in which an insulating film 202, an insulating planarization film 203, and a window insulating film 204 are formed in order on the glass substrate 201, and an organic EL device 21 is installed on a concave portion 204A of the window insulating film 204. Here, among the respective configuration devices of the driving circuit, only the driving transistor 22 is illustrated, but illustration of other configuration devices is omitted.

The organic EL device 21 is composed of an anode electrode 205, an organic layer (electron transport layer, a luminous layer, and a hole transport layer/hole injection layer) 206, and a cathode layer 207. The anode electrode 205 is composed of a metal and the like, which is formed on the bottom portion of the concave portion 204A of the window insulating film 204. The organic layer 206 is formed on the anode electrode 205. The cathode electrode 207 is composed of a transparent conduction layer and the like, which is formed commonly to the whole pixel on the organic layer 206.

In the organic EL device 21, the organic layer 206 is formed on the anode electrode 205 by sequentially depositing a hole transport layer/hole injection layer 2061, a luminous layer 2062, an electron transport layer 2063, and an electron injection layer (not illustrated). Also, as current flows from the driving transistor 22 to the organic layer 206 through the anode electrode 205 under the current driving by the driving transistor 22 of FIG. 2, the luminous layer 2062 emits light when electrons and holes are recombined in the luminous layer 2062 in the organic layer 206.

The driving transistor 22 is composed of a gate electrode 221, source/drain regions 223 and 224 installed on both sides of a semiconductor layer 222, and a channel forming region 225 of a portion that is opposite to the gate electrode 221 of the semiconductor layer 222. The source/drain region 223 is electrically connected to the anode electrode 205 of the organic EL device 21 through contact holes.

Also, as illustrated in FIG. 3, after the organic EL device 21 is formed on the glass substrate 201 in the unit of a pixel via the insulating film 202, the insulating planarization film 203, and the window insulating film 204, a sealing substrate 209 is bonded via a passivation film 208 by an adhesive 210. As the organic EL device 21 is sealed by the sealing substrate 209, the display panel 70 is formed.

[1-2. Basic Circuit Operation]

Now, the basic circuit operation of the organic EL display device 10 as configured above will be described using operation diagrams of FIGS. 5A to 5D and 6A to 6D based on the timing waveform diagram of FIG. 4. In the operation diagrams of FIGS. 5A to 5D and 6A to 6D, for the simplicity of the drawings, the write-in transistor 23 is illustrated as a switch symbol. Also, an equivalent capacitance 25 of the organic EL device 21 is also illustrated.

Figure 4:
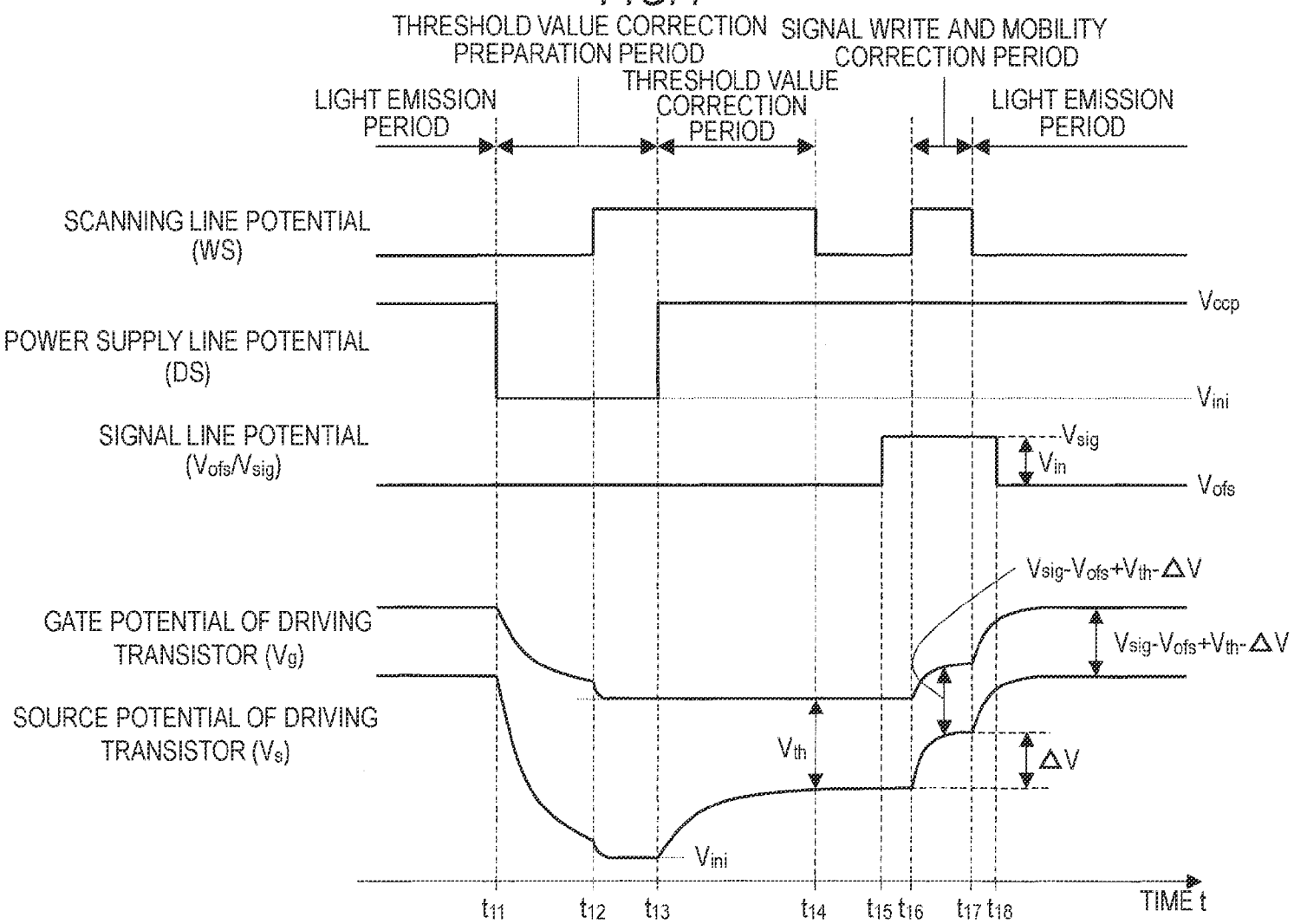
FIG. 4 is a timing waveform diagram illustrating a basic circuit operation of an organic EL display device to which the invention is applied.

The timing waveform diagram of FIG. 4 illustrates the changes of the potential (write-in scanning signal) WS of the scanning line 31, the potential (power supply potential) DS of the power supply line 32, the potential $V_{sig}/V_{ofs}$ of the signal line 33, the gate potential $V_g$, and the source potential $V_s$ of the driving transistor 22.

(Light Emission Period of Previously Displayed Frame)

In the timing waveform diagram of FIG. 4, before the time $t_{11}$, there exists the light emission period of the organic EL device 21 in the previously displayed frame. In the light emission period of the previously displayed frame, the potential DS of the power supply line 32 reaches the first power supply potential (hereinafter referred to as "high potential") $V_{ccp}$, and the write-in transistor 23 is in a non-conductive state.

Figure 5A:
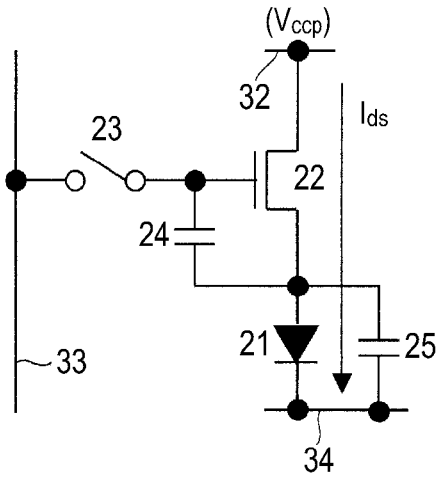
FIGS. 5A to 5D are diagrams illustrating a (one of) basic circuit operation of an organic EL display device to which the invention is applied.

In this case, the driving transistor 22 is designed to operate in a saturation region. Accordingly, as illustrated in FIG. 5A, the driving current (drain-source current) $I_{ds}$ according to the gate-source voltage $V_{gs}$ of the driving transistor 22 is supplied from the power supply line 32 to the organic EL device 21 through the driving transistor 22. Accordingly, the organic EL device 21 emits light with luminance according to the current value of the driving current $I_{ds}$.

(Threshold Value Correction Preparation Period)

Figure 5B:
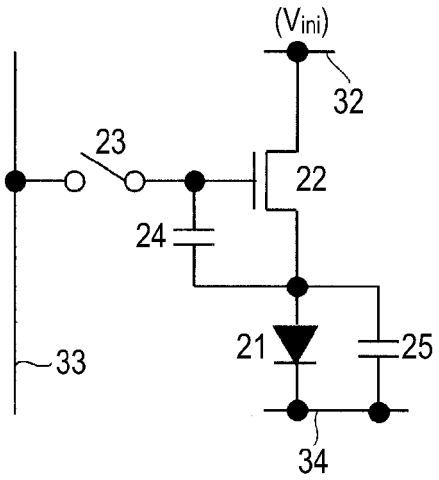

At the time $t_{11}$, a new display frame (current display frame) of the progressive scan line comes in. Also, as illustrated in FIG. 5B, the potential DS of the power supply line 32 is changed from a high potential $V_{ccp}$ to the second power supply potential (hereinafter described as "low potential") $V_{ini}$ that is sufficiently lower than $V_{ofs}$-$V_{th}$ for the reference voltage $V_{ofs}$.

Here, it is assumed that the threshold voltage of the organic EL device 21 is $V_{thel}$ and the potential (cathode potential) of the common power supply line 34 is $V_{cath}$. In this case, if it is assumed that the low potential $V_{ini}$ is $V_{ini}<V_{thel}+V_{cath}$, the source potential $V_s$ of the driving transistor 21 becomes almost the same as the low potential $V_{ini}$, and thus the organic EL device 21 is in a reverse bias state to be extinct.

Figure 5C:
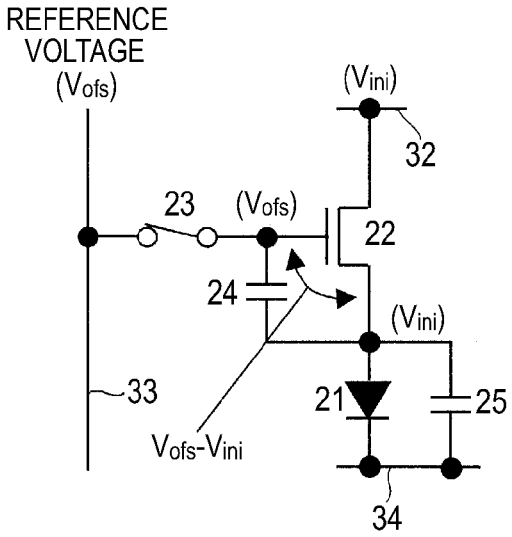

Next, at the time $t_{12}$, the potential WS of the scanning line 31 is shifted from the low potential side to the high potential side, and as illustrated in FIG. 5C, the write-in transistor 23 is in a conductive state. At this time, since the reference voltage $V_{ofs}$ has been supplied from the signal output circuit 60 to the signal line 33, the gate potential $V_g$ of the driving transistor 22 becomes the reference voltage $V_{ofs}$. Also, the source potential $V_s$ of the driving transistor 22 reaches the potential $V_{ini}$ that is sufficiently lower than the reference voltage $V_{ofs}$.

At this time, the gate-source voltage $V_{gs}$ of the driving transistor 22 becomes $V_{ofs}$-$V_{ini}$. Here, if $V_{ofs}$-$V_{ini}$ is not larger than the threshold voltage $V_{th}$ of the driving transistor 22, the threshold value correction process to be described later may not be performed, and thus it is necessary to set the potential relationship in that $V_{ofs}-V_{ini}$ becomes $V_{ofs}$-$V_{ini}>V_{th}$.

As described above, the initialization process of fixing the gate potential $V_g$ of the driving transistor 22 to the reference voltage $V_{ofs}$ and fixing (deciding) the source potential $V_s$ to the low potential $V_{ini}$ is a preparation (threshold value correction preparation) process before the threshold value correction process (threshold value correction operation) to be described later is performed. Accordingly, the reference voltage $V_{ofs}$ and the low potential $V_{ini}$ become the initialization potentials of the gate potential $V_g$ and the source potential $V_s$ of the driving transistor 22.

(Threshold Value Correction Period)

Figure 5D:
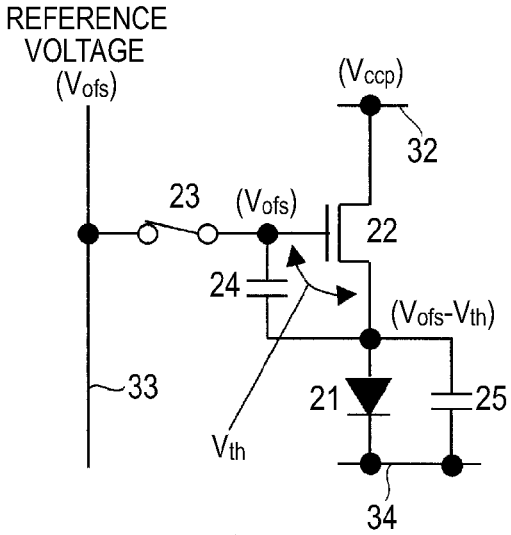

Next, at the time $t_{13}$, as illustrated in FIG. 5D, if the potential DS of the power supply line 32 is changed from the low potential $V_{ini}$ to the high potential $V_{ccp}$, the threshold value correction process starts in a state where the gate potential $V_g$ of the driving transistor 22 is maintained. That is, the source potential $V_s$ of the driving transistor 22 starts increasing toward the potential that is obtained by subtracting the threshold voltage $V_{th}$ of the driving transistor 22 from the gate potential $V_g$.

Here, for convenience, the process of changing the source potential $V_s$ toward the potential that is obtained by subtracting the threshold voltage $V_{th}$ of the driving transistor from the initialization potential $V_{ofs}$ based on the initialization potential $V_{ofs}$ of the gate electrode of the driving transistor is called a threshold value correction process. If this threshold value correction process is performed, the gate-source voltage $V_{gs}$ of the driving transistor 22 converges to the threshold voltage $V_{th}$ of the driving transistor 22. The voltage that corresponds to the threshold voltage $V_{th}$ is maintained in the maintenance capacity 24.

In a period (threshold value correction period) in which the threshold value correction process is performed, in order to make the current flow only to the side of the maintenance capacity 24 but not flow to the side of the organic EL device 21, the potential $V_{cath}$ of the common power supply line 34 is set so that the organic EL device 21 is in a cutoff state.

Figure 6A:
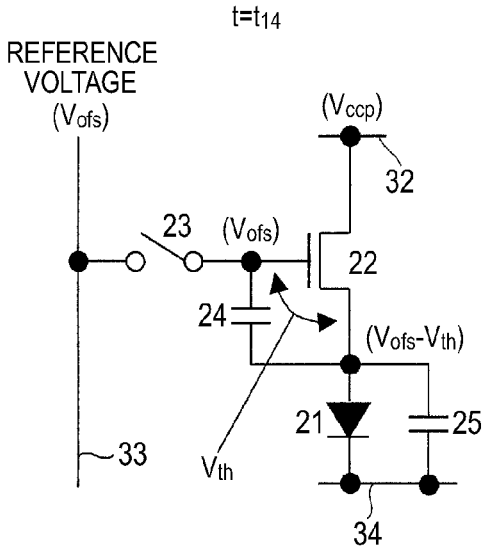
FIGS. 6A to 6D are diagrams illustrating a (another) basic circuit operation of an organic EL display device to which the invention is applied.

Next, at the time $t_{14}$, the potential WS of the scanning line 31 is shifted to the low potential side, and as illustrated in FIG. 6A, the write-in transistor 23 becomes a non-conductive state. At this time, the gate electrode of the driving transistor 22 is electrically cut off from the signal line 33, and thus becomes a floating state. However, since the gate-source voltage $V_{gs}$ becomes equal to the threshold voltage $V_{th}$ of the driving transistor 22, the driving transistor 22 is in a cutoff state. Accordingly, the drain-source current $I_{ds}$ does not flow through the driving transistor 22.

(Signal Write and Mobility Correction Period)

Figure 6B:
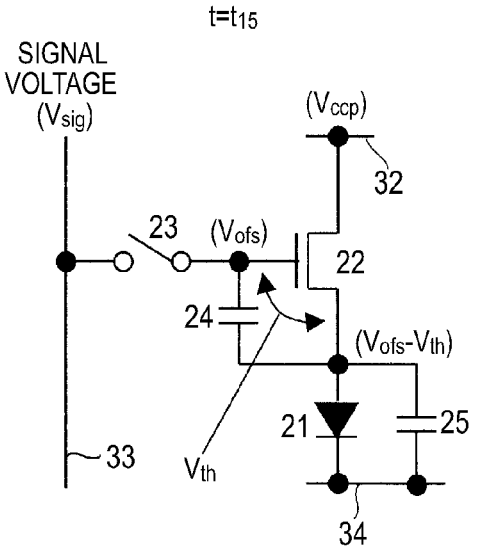
Figure 6C:
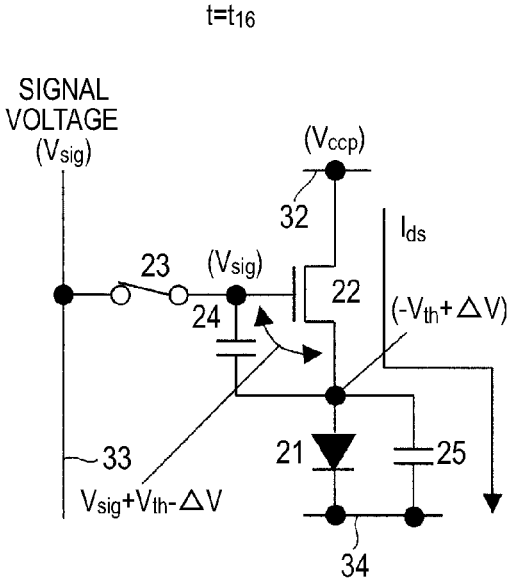

Next, at the time $t_{15}$, as illustrated in FIG. 6B, the potential of the signal line 33 is changed from the reference voltage $V_{ofs}$ to the signal voltage $V_{sig}$ of the image signal. Then, at the time $t_{16}$, the potential WS of the scanning line 31 is shifted to the high potential side, and as illustrated in FIG. 6C, the write-in transistor 23 becomes a conductive state, and samples and stores the signal voltage $V_{sig}$ of the image signal in the pixel 20.

As the write-in transistor 23 writes the signal voltage $V_{sig}$, the gate potential $V_g$ of the driving transistor 22 becomes the signal voltage $V_{sig}$. Also, when the driving transistor 22 is driven by the signal voltage $V_{sig}$ of the image signal, the threshold voltage $V_{th}$ of the driving transistor 22 and the voltage that corresponds to the threshold voltage $V_{th}$ maintained in the maintenance capacity 24 cancel each other. The principle of threshold value cancellation will be described in detail later.

At this time, the organic EL device 21 is in a cutoff state (in high impedance state). Accordingly, the current (drain-source current $I_{ds}$) flowing from the power supply line 32 to the driving transistor 22 in accordance with the signal voltage $V_{sig}$ of the image signal flows into the equivalent capacitance 25 of the organic EL device 21, and the charging of the equivalent capacitance 25 starts.

As the equivalent capacitance 25 of the organic EL device 21 is charged, the source potential $V_s$ of the driving transistor 22 is increased as time lapses. In this case, the dispersion of the threshold voltage $V_{th}$ of the driving transistor 22 for each pixel has already been cancelled, and the drain-source current $I_{ds}$ of the driving transistor 22 depends on the mobility μ of the driving transistor 22. The mobility μ of the driving transistor 22 is the mobility of a semiconductor thin film that forms the channel of the driving transistor 22.

Here, it is assumed that the ratio of the maintenance voltage $V_{gs}$ of the maintenance capacity 24 to the signal voltage $V_{sig}$ of the image signal, that is, the write gain G is 1 (ideal value). As the source potential $V_s$ of the driving transistor is increased up to the potential of $V_{ofs}-V_{th}+\Delta V$, the gate-source voltage $V_{gs}$ of the driving transistor 22 becomes $V_{sig}-V_{ofs}+V_{th}-\Delta V$.

That is, the increment ΔV of the source potential $V_s$ of the driving transistor 22 acts to be subtracted from the voltage $(V_{sig}-V_{ofs}+V_{th})$ maintained in the maintenance capacity 24, in other words, acts to perform discharge of the maintenance capacitance 24 to put a negative feedback. Accordingly, the increment ΔV of the source potential $V_s$ becomes the feedback amount of the negative feedback.

As described above, by putting a negative feedback on the gate-source voltage $V_{gs}$ with the feedback amount ΔV according to the drain-source current $I_{ds}$ flowing through the driving transistor 22, the dependence on the mobility μ of the drain-source current Ids of the driving transistor 22 can be cancelled. This process of cancelling the dependence is the mobility correction process that corrects the dispersion of the mobility μ of the driving transistor 22 for each pixel.

More specifically, since the drain-source current $I_{ds}$ is increased as the signal amplitude $V_{in}$ $(=V_{sig}-V_{ofs})$ of the image signal that is written on the gate electrode of the driving transistor 22 becomes high, an absolute value of the feedback amount ΔV of the negative feedback is also increased. Accordingly, the mobility correction process according to the luminance level is performed.

Also, in the case where the signal amplitude $V_{in}$ of the image signal is constant, the absolute value of the feedback amount ΔV of the negative feedback becomes large as the mobility μ of the driving transistor 22 is increased, and thus the dispersion of the mobility μ for each pixel can be removed. Accordingly, the feedback amount ΔV of the negative feedback may be the correction amount of mobility correction. The details of the principle of the mobility correction will be described later.

(Light Emission Period)

Figure 6D:
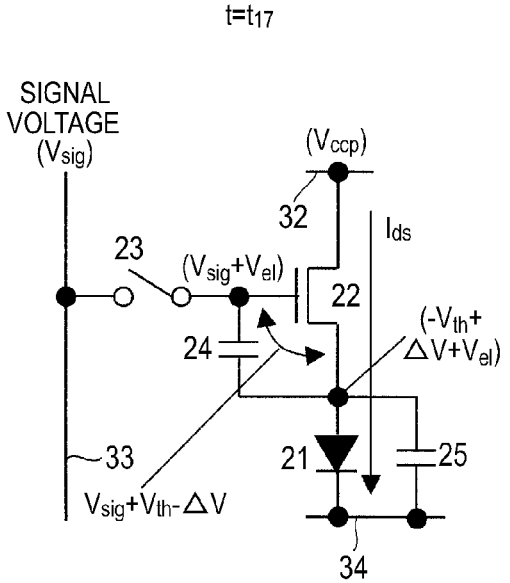

Next, at time $t_{17}$, the potential WS of the scanning line 31 is shifted to the low potential side, as illustrated in FIG. 6D, and thus the write-in transistor 23 becomes in a non-conductive state. Accordingly, the gate electrode of the driving transistor 22 is electrically cut off from the signal line 33, and thus is in a floating state.

Here, when the gate electrode of the driving transistor 22 is in a floating state, the gate potential $V_g$ is also changed in association with the change of the source potential $V_s$ of the driving transistor 22 since the maintenance capacity 24 is connected between the gate and source of the driving transistor 22. As described above, the change operation of the gate potential $V_g$ of the driving transistor 22 in association with the change of the source potential $V_s$ is a bootstrap operation by the maintenance capacity 24.

As the gate electrode of the driving transistor 22 is in a floating state and the drain-source current $I_{ds}$ of the driving transistor 22 flows to the organic EL device 21, the anode potential of the organic EL device 21 is increased according to the corresponding current $I_{ds}$.

Also, if the anode potential of the organic EL device 21 exceeds $V_{thel}+V_{cath}$, a driving current flows to the organic EL device 21, and thus the light emission of the organic EL device 21 starts. Also, the increase of the anode potential of the organic EL device 21 corresponds to the increase of the source potential $V_s$ of the driving transistor 22. If the source voltage of the driving transistor 22 is increased, the gate potential $V_g$ of the driving transistor 22 is also increased in association by the bootstrap operation of the maintenance capacity 24.

In this case, if it is assumed that the bootstrap gain is 1 (ideal value), the increase amount of the gate potential $V_g$ becomes equal to the increase amount of the source potential $V_s$. Accordingly, during the light emission period, the gate-source voltage $V_{gs}$ of the driving transistor 22 is constantly maintained as $V_{sig}-V_{ofs}+V_{th}-\Delta V$. Also, at time $t_{18}$, the potential of the signal line 33 is changed from the signal voltage $V_{sig}$ of the image signal to the reference voltage $V_{ofs}$.

In a series of circuit operation as described above, respective processing operations of threshold value correction preparation, threshold value correction, write (signal write) of the signal voltage $V_{sig}$, and mobility correction are performed in one horizontal scanning period (1H). Also, respective processing operations of signal write and mobility correction are executed in parallel in a time period of $t_6$ to $t_7$.

(Divided Threshold Value Correction)

Here, it is exemplified that the threshold value correction process is executed only once. However, this driving method is merely exemplary, and the invention is not limited to this driving method. For example, it is also possible to adopt a driving method that performs the threshold value correction process plural times in a divided manner through a plurality of horizontal scanning periods that precede the 1H period, that is, a driving method that performs a so-called divided threshold value correction in addition to the 1H period in which the threshold value correction process is performed together with the mobility correction and the signal write process.

According to the driving method for divided threshold value correction, even if the time that is allocated in one horizontal scanning period is shortened by the multi-pixels according to the high definition, a sufficient time can be secured through a plurality of horizontal scanning period as the threshold value correction period, and thus the threshold value correction process can be accurately performed.

[Principle of Threshold Value Cancellation]

Here, the principle of threshold value cancellation (that is, threshold value correction) of the driving transistor 22 will now be described. Since the driving transistor 22 is designed to operate in a saturation region, it operates as a constant current source. Accordingly, a constant drain-source current (driving current) $I_{ds}$ that is given by the following equation (1) is supplied from the driving transistor 22 to the organic EL device 21.

$$I_{ds}=(1/2)\cdot\mu(W/L)C_{ox}(V_{gs}-V_{th})^2 \quad (1)$$

Here, W denotes a channel width of the driving transistor 22, L denotes a channel length, and $C_{ox}$ denotes a gate capacitance per unit area.

Figure 7:
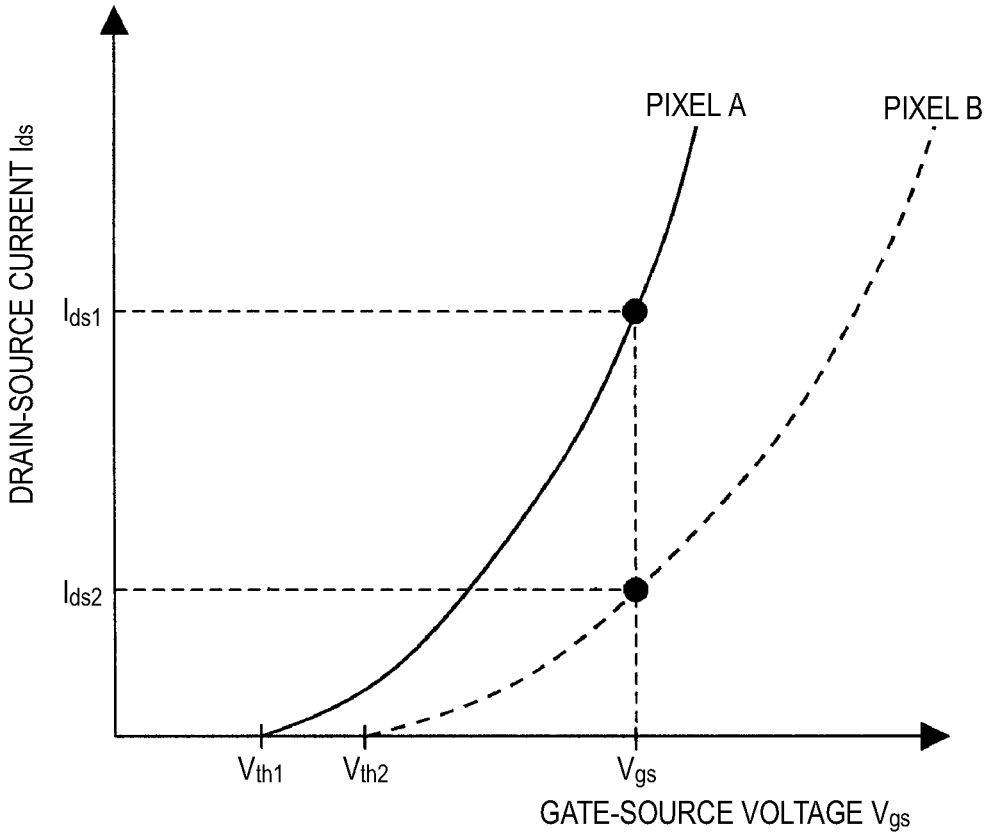
FIG. 7 is a characteristic diagram illustrating the subject that is caused by dispersion of the threshold voltages $V_{th}$ of a driving transistor.

FIG. 7 illustrates the characteristics of the drain-source current $I_{ds}$ versus the gate-source voltage $V_{gs}$ of the driving transistor 22.

As illustrated in this characteristic diagram, if a cancellation process is not performed with respect to the dispersion for each pixel of the threshold voltage $V_{th}$ of the driving transistor 22, the drain-source current $I_{ds}$ that corresponds to the gate-source voltage $V_{gs}$ becomes $I_{ds1}$ when the threshold voltage $V_{th}$ is $V_{th1}$.

By contrast, if the threshold voltage $V_{th}$ is $V_{th2}$ $(V_{th2}>V_{th1})$ in the same manner, the drain-source current $I_{ds}$ that corresponds to the gate-source voltage $V_{gs}$ becomes $I_{ds2}$ ($I_{ds2}<I_{ds1}$). That is, if the threshold voltage $V_{th}$ of the driving transistor 22 is changed, the drain-source current $I_{ds}$ is changed even though the gate-source voltage $V_{gs}$ is constant.

On the other hand, in the pixel (pixel circuit) 20 having the above-described configuration, as described above, the gate-source voltage $V_{gs}$ of the driving transistor 22 during the light emission is $V_{sig}-V_{ofs}+V_{th}\Delta V$. Accordingly, by substituting this in equation (1), the drain-source current $I_{ds}$ is expressed as in the following equation (2).

$$I_{ds}=(1/2)\cdot\mu(W/L)C_{ox}(V_{sig}-V_{ofs}\Delta V)^2 \quad (2)$$

That is, the term of the threshold voltage $V_{th}$ of the driving transistor 22 is cancelled, and the drain-source current $I_{ds}$ that is supplied from the driving transistor 22 to the organic EL device 21 is not dependent upon the threshold voltage $V_{th}$ of the driving transistor 22. As a result, even if the threshold voltage $V_{th}$ of the driving transistor 22 is changed for each pixel due to the dispersion or time-dependent change of the manufacturing process of the driving transistor 22, the drain-source current $I_{ds}$ is not changed, and thus the luminance of the organic EL device 21 can be maintained constant.

(Principle of Mobility Correction)

Figure 8:
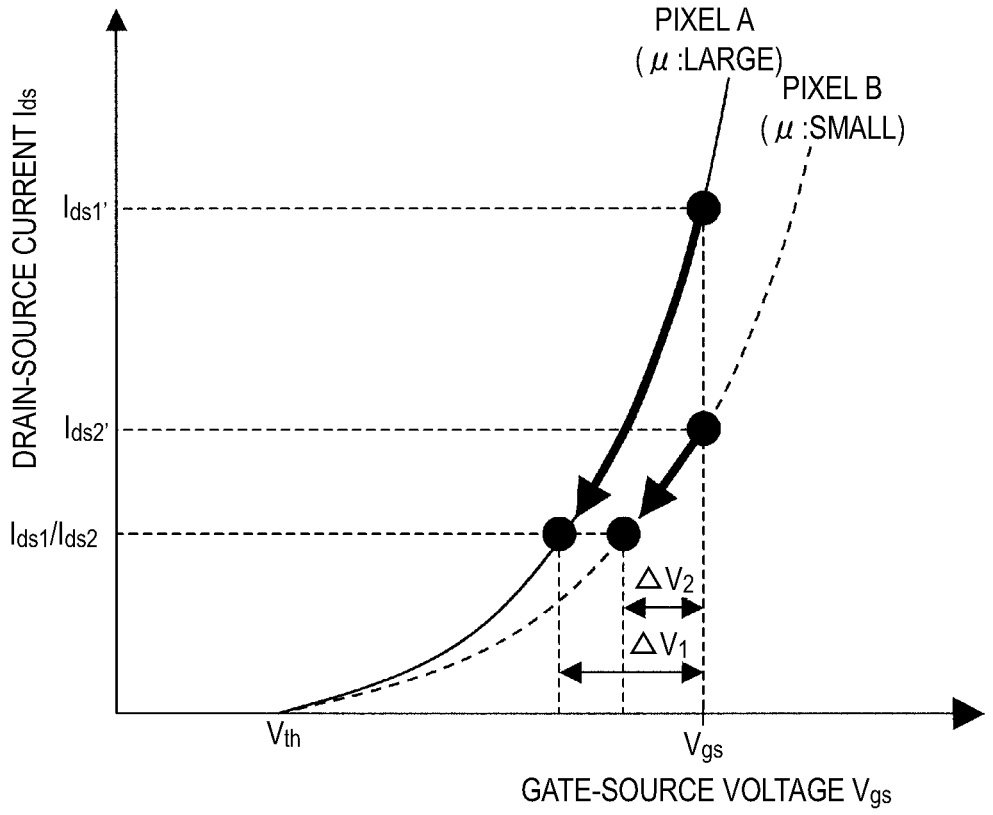
FIG. 8 is a characteristic diagram illustrating the subject that is caused by dispersion of the mobility μ of a driving transistor.

Next, the principle of mobility correction of the driving transistor 22 will be described. FIG. 8 illustrates characteristic curves in a state where a pixel A in which the mobility μ of the driving transistor 22 is relatively large and a pixel B in which the mobility μ of the driving transistor 22 is relatively small are compared with each other. In the case where the driving transistor 22 is formed of a polysilicon thin film transistor or the like, it is unavoidable that the mobility μ is changed between pixels such as pixel A and pixel B.

A case is considered, in which the signal amplitude $V_{in}$ ($=V_{sig}-V_{ofs}$) of the same level is written on the gate electrode of the driving transistor 22, for example, in both pixels A and B. In this case, if the correction of the mobility μ is not performed, there is a large difference between the drain-source current $I_{ds1}$ that flows to the pixel A having a high mobility μ and the drain-source current $I_{ds2}'$ that flows to the pixel B having a low mobility μ. As described above, if there is a large difference in drain-source current $I_{ds}$ between the pixels due to the dispersion of the mobility μ for each pixel, the uniformity of the screen is damaged.

Here, as can be known from the transistor characteristic equation (1) as described above, if the mobility μ is high, the drain-source current $I_{ds}$ becomes large. Accordingly, the feedback amount ΔV of the negative feedback becomes large as the mobility μ becomes large. As illustrated in FIG. 8, the feedback amount $\Delta V_1$ of the pixel A having a high mobility is larger than the feedback amount $\Delta V_2$ of the pixel B having a low mobility.

Accordingly, by putting a negative feedback on the gate-source voltage $V_{gs}$ with the feedback amount ΔV according to the drain-source current $I_{ds}$ of the driving transistor 22 by the mobility correction process, the negative feedback becomes larger as the mobility μ becomes higher. As a result, the dispersion of the mobility μ for each pixel can be suppressed.

Specifically, if the feedback amount $\Delta V_1$ is corrected in a pixel A having a high mobility μ, the drain-source current $I_{ds}$ greatly descends from $I_{ds1}'$ to $I_{ds1}$. On the other hand, since the feedback amount $\Delta V_2$ of the pixel B having a low mobility is small, the drain-source current $I_{ds}$ descends from $I_{ds2}'$ to $I_{ds2}$, and does not descend any further. As a result, since the drain-source current $I_{ds1}$ of the pixel A becomes almost equal to the drain-source current $I_{ds2}$, the dispersion of the mobility μ for each pixel is corrected.

In summary, if pixels A and B have different mobility μ, the feedback amount $\Delta V_1$ of the pixel A having a high mobility μ becomes larger than the feedback amount $\Delta V_2$ of the pixel B having a low mobility μ. That is, as the mobility μ becomes higher, the feedback amount ΔV of the pixel becomes larger and the reduction amount of the drain-source current $I_{ds}$ becomes larger.

Accordingly, by putting a negative feedback on the gate-source voltage $V_{gs}$ with the feedback amount ΔV according to the drain-source current $I_{ds}$ of the driving transistor 22, the current values of the drain-source currents $I_{ds}$ of the pixels having different mobility μ become uniform. As a result, the dispersion of the mobility μ for each pixel can be corrected. That is, the process of putting a negative feedback on the gate-source voltage $V_{gs}$ of the driving transistor 22 with the feedback amount ΔV according to the current (the drain-source current $I_{ds}$) that flows to the driving transistor 22 becomes the mobility correction process.

Here, in the pixel (pixel circuit) 20 as illustrated in FIG. 2, the relationship between the signal voltage $V_{sig}$ of an image signal and the drain-source current $I_{ds}$ of the driving transistor 22 according to existence/nonexistence of the threshold value correction and mobility correction will be described using FIGS. 9A to 9C.

Figure 9A:
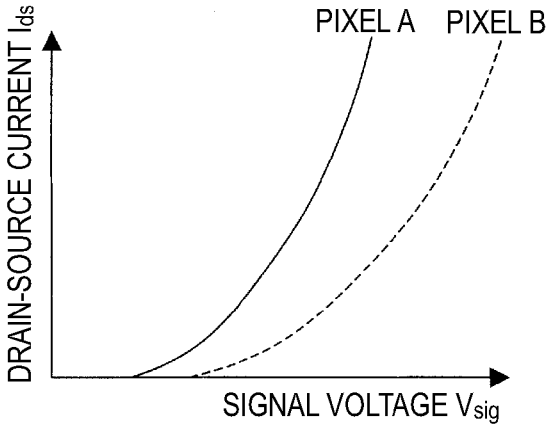
FIGS. 9A to 9C are characteristic diagrams illustrating the relationship between the signal voltage $V_{sig}$ of an image signal and the drain-source current $I_{ds}$ of the driving transistor according to the existence/nonexistence of threshold value correction and mobility correction.
Figure 9B:
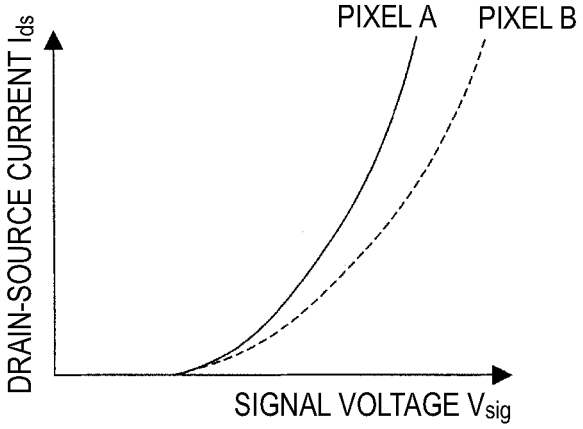
Figure 9C:
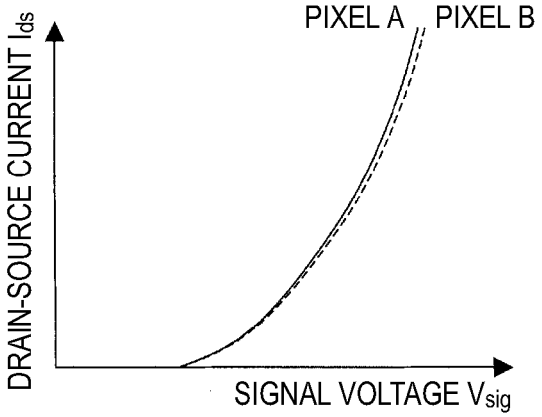

FIG. 9A shows a case where neither the threshold value correction nor the mobility correction is performed, FIG. 9B shows a case where the mobility correction is not performed, but the threshold value correction is performed, and FIG. 9C shows a case where both the threshold value correction and the mobility correction are performed. In the case where neither the threshold value correction nor the mobility correction is performed as shown in FIG. 9A, a great difference in drain-source current $I_{ds}$ occurs between the pixels A and B due to the dispersion of the threshold voltage $V_{th}$ and the mobility μ between the pixels A and B.

In the case where only the threshold value correction is performed as shown in FIG. 9B, the dispersion of the drain-source current $I_{ds}$ can be somewhat reduced, but there remains a difference in drain-source current $I_{ds}$ between the pixels A and B due to the dispersion of the mobility μ between the pixels A and B. Also, in the case where both the threshold value correction and the mobility correction are performed as shown in FIG. 9C, the difference in drain-source current $I_{ds}$ between the pixels A and B due to the dispersion of the threshold voltage $V_{th}$ and the mobility μ between the pixels A and B can be almost eliminated. Accordingly, the luminance dispersion of the organic EL device 21 does not occur in any grayscale, and thus a good quality display image can be obtained.

Also, since the pixel 20 illustrated in FIG. 2 has a function of a bootstrap operation by the above-described maintenance capacity 24 in addition to the function of the threshold value correction and the mobility correction, the following effects can be obtained.

That is, even if the source potential Vs of the driving transistor 22 is changed according to the time-dependent change of the I-V characteristics of the organic EL device 21, the gate-source potential $V_{gs}$ of the driving transistor 22 can be maintained constant by the bootstrap operation through the maintenance capacity 24. Accordingly, the current that flows to the organic EL device 21 is not changed but is maintained constant. As a result, the luminance of the organic EL device is maintained constant, and thus even if the I-V characteristic of the organic EL device 21 is time-dependently changed, an image display accompanying no luminance deterioration can be realized.

[1-3. Regarding Bootstrap Operation]

Figure 10:
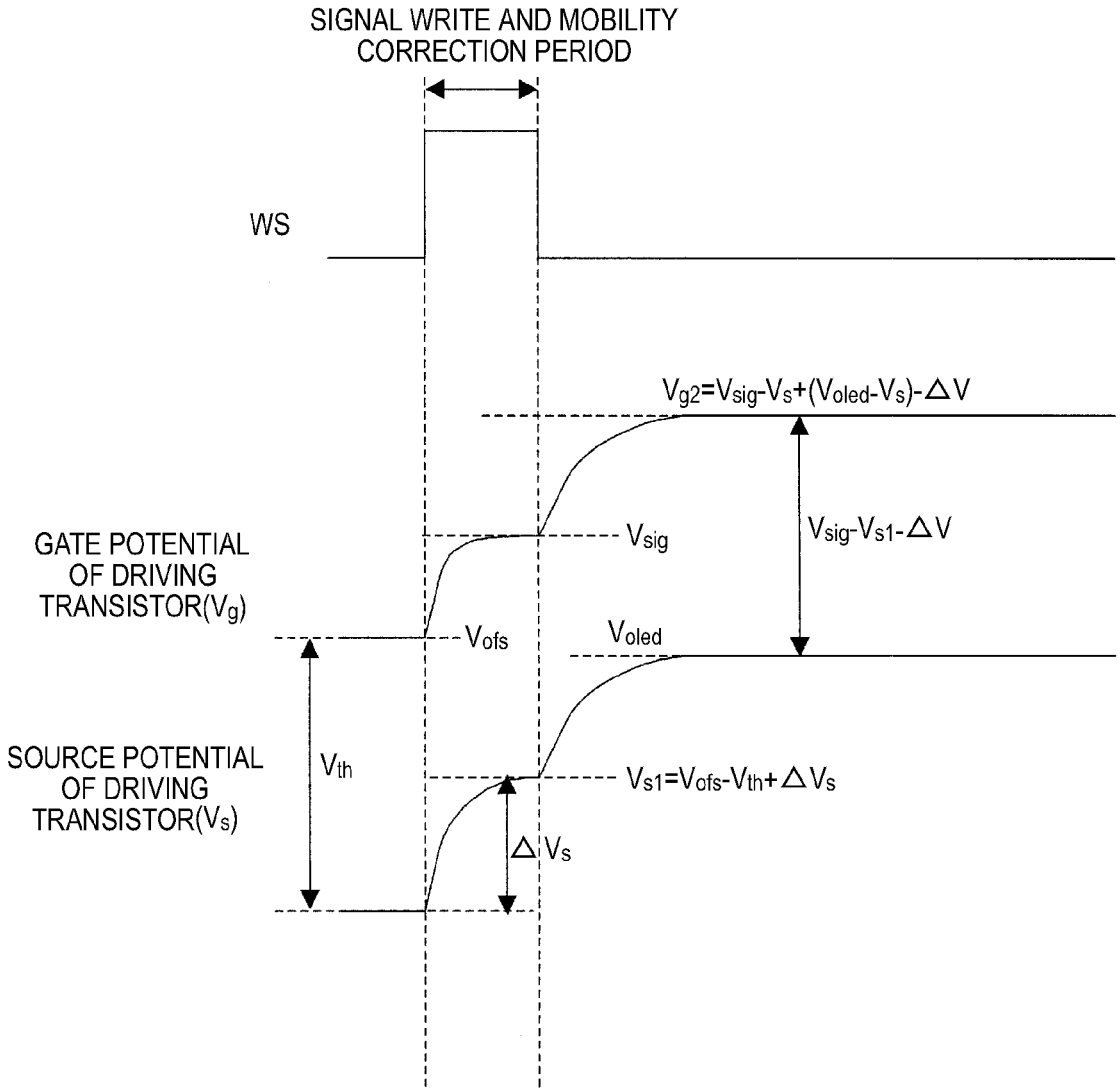
FIG. 10 is a timing waveform diagram illustrating the bootstrap operation.

Here, the above-described bootstrap operation will be described in detail using the timing waveform diagram of FIG. 10.

As can be known from the circuit operation as described above, at a time when the signal write and mobility correction period is ended, the signal voltage $V_{sig}$ of the image signal is written on the gate electrode of the driving transistor 22. In this case, the source potential $V_s$ of the driving transistor 22 reaches the potential $V_{s1}$ ($=V_{ofs}-V_{th}+\Delta V_s$) that has ascended as high as the increment $\Delta V_s$ of potential according to the mobility μ from the time when the threshold value correction process is completed.

Here, if the write-in transistor 23 is in a non-conductive state, the gate-source voltage $V_{gs}$ of the driving transistor 22 is maintained by the maintenance capacity 24, and thus the source potential $V_s$ ascends up to the potential $V_{oled}$ according to the current $I_{ds}$ that flows to the driving transistor 22. The increment amount at this time is ideally equal to the increment amount $V_{oled}-V_{s1}$ of the source potential $V_s$. However, in the case where parasitic capacitance exists in the driving transistor 22 and the write-in transistor 23, the increment amount becomes smaller than the increment amount of the source potential $V_s$.

(Regarding Bootstrap Gain $G_b$)

Figure 11:
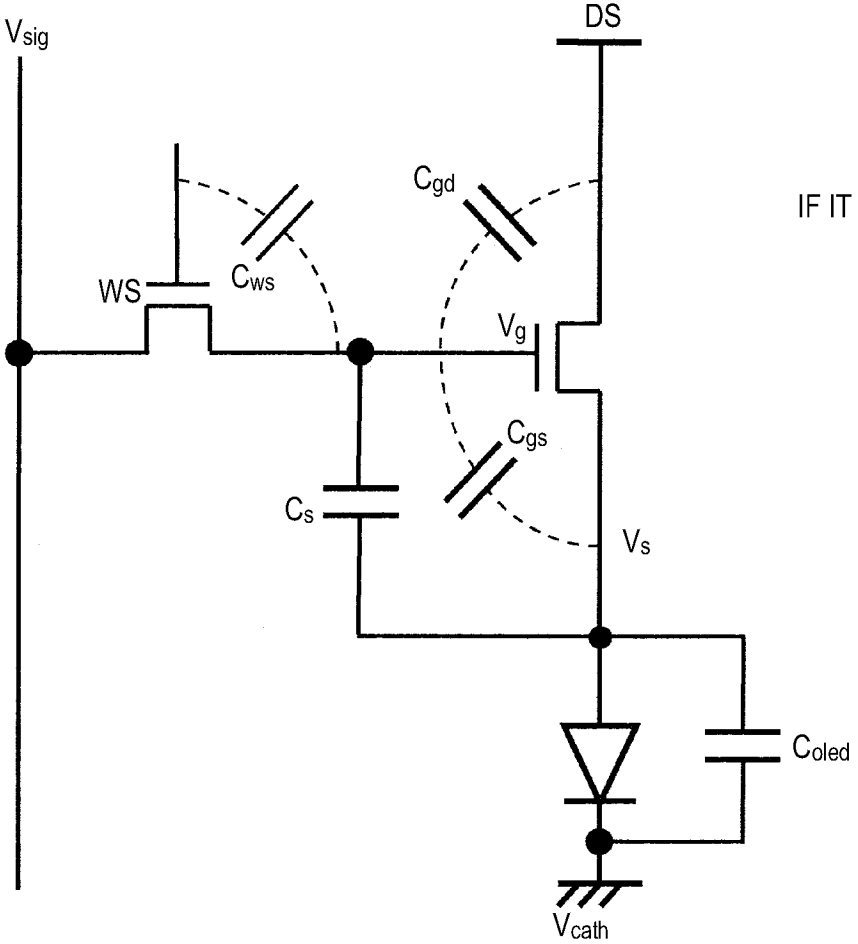
FIG. 11 is a diagram illustrating the bootstrap gain $G_b$.

As illustrated in FIG. 11, parasitic capacitances $C_{gs}$, $C_{gd}$, and $C_{ws}$ exist in the driving transistor 22 and the write-in transistor 23. The parasitic capacitance $C_{gs}$ is a parasitic capacitance between the gate and source of the driving transistor 22, and the parasitic capacitance $C_{gd}$ is a parasitic capacitance between the gate and drain of the driving transistor 22. The parasitic capacitance $C_{ws}$ is a parasitic capacitance between the gate and drain of the write-in transistor 23.

Here, it is assumed that the gate potential $V_g$ and the source potential $V_s$ before the bootstrap operation of the driving transistor 22 are $V_{g1}$ and $V_{s1}$, respectively, and the gate potential $V_g$ and the source potential $V_s$ after the bootstrap operation are $V_{g2}$ and $V_{s2}$, respectively.

Now, if it is assumed that the source potential $V_s$ of the driving transistor 22 has ascended from the potential $V_{s1}$ to the potential $V_{s2}$, the gate potential $V_g$ ascends only up to $(C_s+C_{gs})/(C_s+C_{gs}+C_{gd}+C_{ws})\times(V_{s2}V_{s1})$. The coefficient at this time, that is, $(C_s+C_{gs})/(C_s+C_{gs}+C_{gd}+C_{ws})$, becomes the bootstrap gain $G_b$, and this bootstrap gain $G_b$ should be equal to or less than 1. Accordingly, the increment amount $\Delta V_s$ of the gate potential $V_g$ becomes smaller than the increment amount $\Delta V_g$ of the source potential $V_s$.

As described above, in the case where the parasitic capacitance exists in the driving transistor 22 and the write-in transistor 23, the increment amount $\Delta V_g$ of the gate potential $V_g$ becomes smaller than the increment amount $\Delta V_s$ of the source potential $V_s$. As a result, by the bootstrap operation, the gate-source voltage $V_{gs}$ of the driving transistor 22 becomes lower than the gate-source voltage $V_{gs}$ at a time when the mobility correction process is completed. Accordingly, in the case where the parasitic capacitance that is parasitic on the gate electrode of the driving transistor 22 is high and the bootstrap gain $G_b$ is low, a desired luminance may not be obtained.

(Regarding Reoccurrence of Dispersion of Threshold Voltage $V_{th}$)

Figure 12:
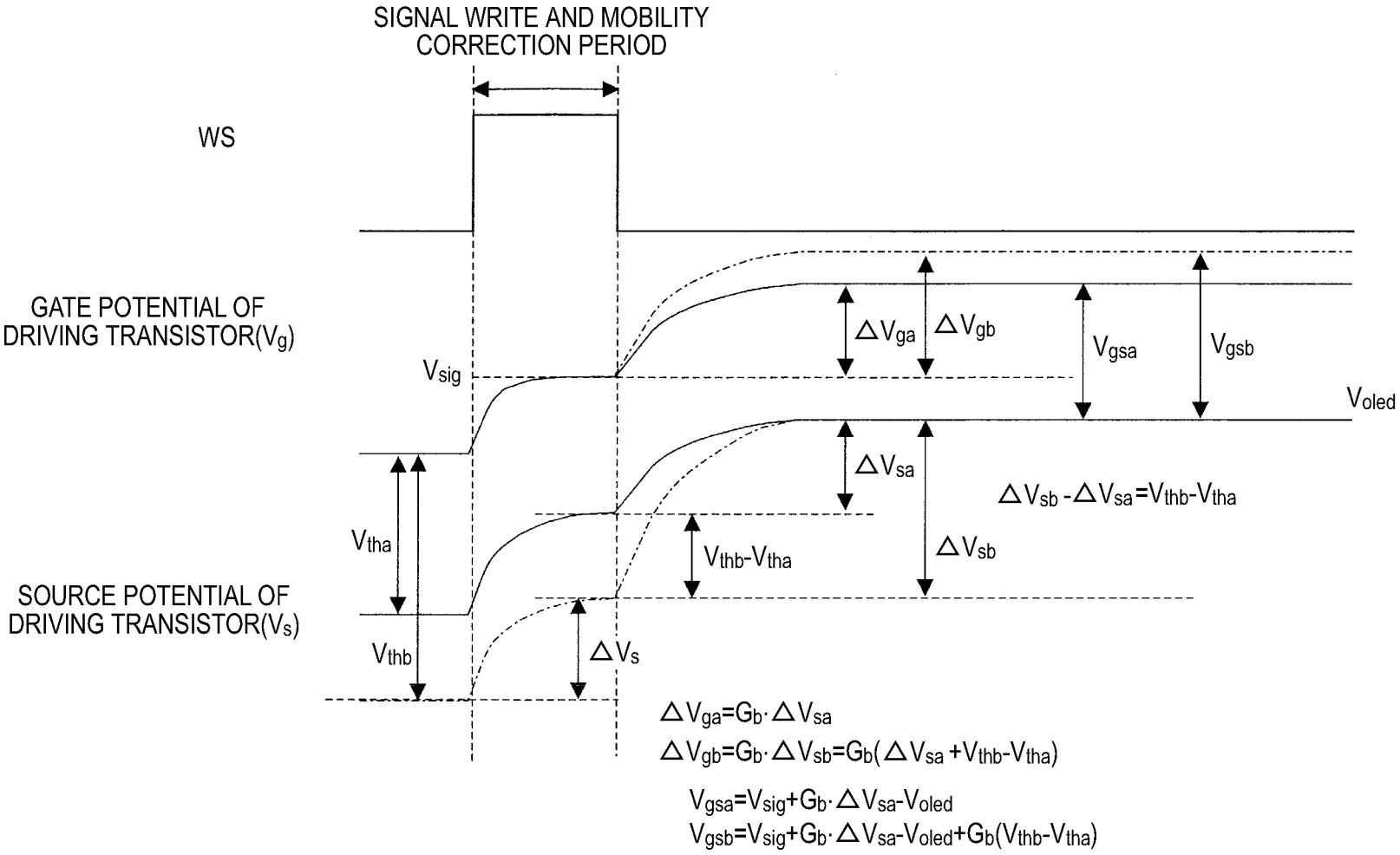
FIG. 12 is a timing waveform diagram illustrating the recurrence of the dispersion of the threshold voltage $V_{th}$.

Also, as illustrated in FIG. 12, it is considered that the driving transistor 22 has different threshold voltages $V_{tha}$ and $V_{thb}$. After completion of the threshold value correction operation, the difference in gate-source voltage $V_{gs}$ between a transistor having the threshold voltage $V_{tha}$ and a transistor having the threshold voltage $V_{thb}$ becomes $V_{thb}-V_{tha}$. Even in the mobility correction operation, the increment amount $\Delta V_s$ of the source potential $V_s$ is not dependent upon the threshold voltage $V_{th}$, and thus the different in the gate-source voltage $V_{gs}$ is maintained as $V_{thb}-V_{tha}$.

In the case of the bootstrap operation, the source voltage $V_s$ ascends up to the voltage $V_{oled}$ that is determined by the current $I_{ds}$ of the driving transistor 22, and thus the increment amounts $\Delta V_{sa}$ and $\Delta V_{sb}$ of the source potential $V_s$ differ from each other to the extent of the difference $V_{thb}$-$V_{tha}$ of the threshold voltage $V_{th}$. In this case, the increment amount $\Delta V_g$ of the gate potential $V_g$ is determined by the increment amount $\Delta V_s$ of the source potential $V_s$.

Accordingly, as illustrated in FIG. 12, the difference in gate-source voltage $V_{gs}$ after the bootstrap operation becomes $(C_s+C_{gs})/(C_s+C_{gs}+C_{gd}+C_{ws})\times(V_{thb}-V_{tha})$, which is decreased even after the threshold value correction. Accordingly, although the threshold value correction process has been performed, the dispersion of the threshold voltage $V_{th}$ occurs. If the parasitic capacitance is high, the change amount becomes large, and this causes the luminance non-uniformity.

(Regarding High Voltage of Voltage $V_{oled}$ of Organic EL Device 21)

Figure 13:
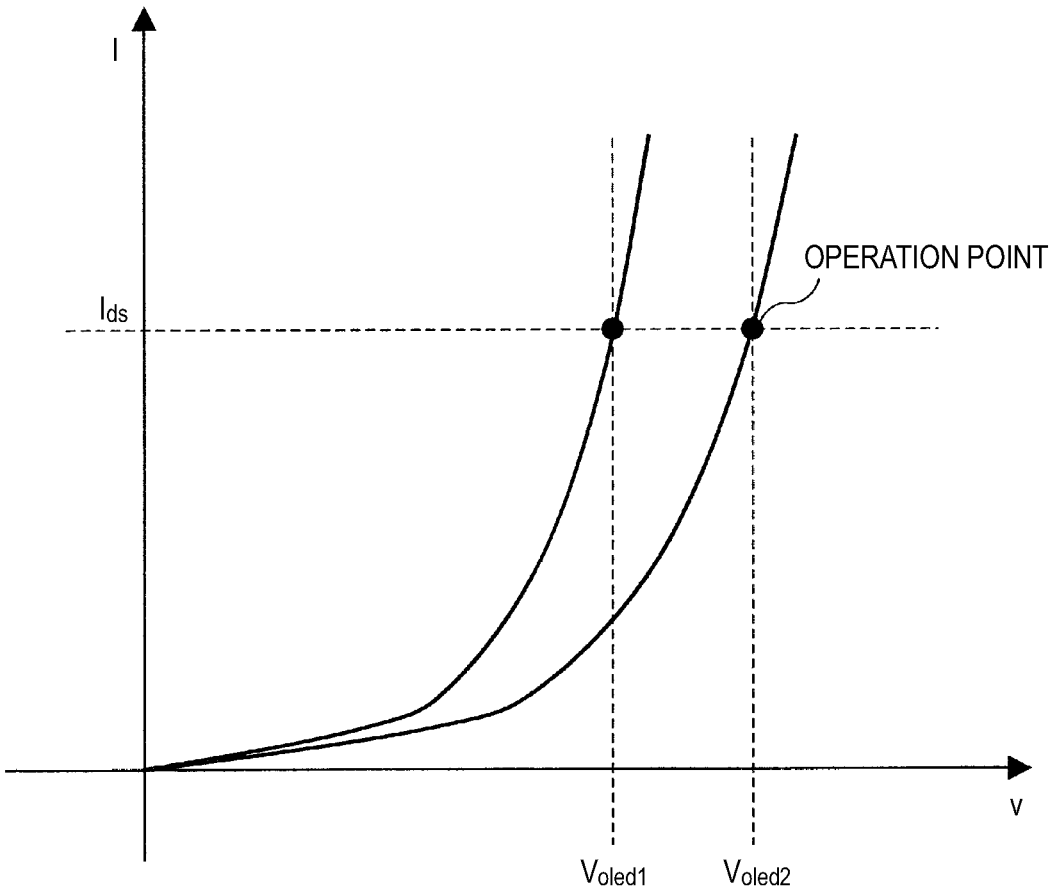
FIG. 13 is a diagram illustrating a state where an operation point of an organic EL device is shifted when the organic EL device deteriorates.

In the case where the organic EL device 21 deteriorates, as illustrated in FIG. 13, the operation point of the organic El device 21 is shifted from the voltage $V_{oled1}$ to the voltage $V_{oled}$. That is, the operation point becomes high voltage. Here, it is considered that the voltage $V_{oled}$ of the organic El device 21 becomes high.

Figure 14:
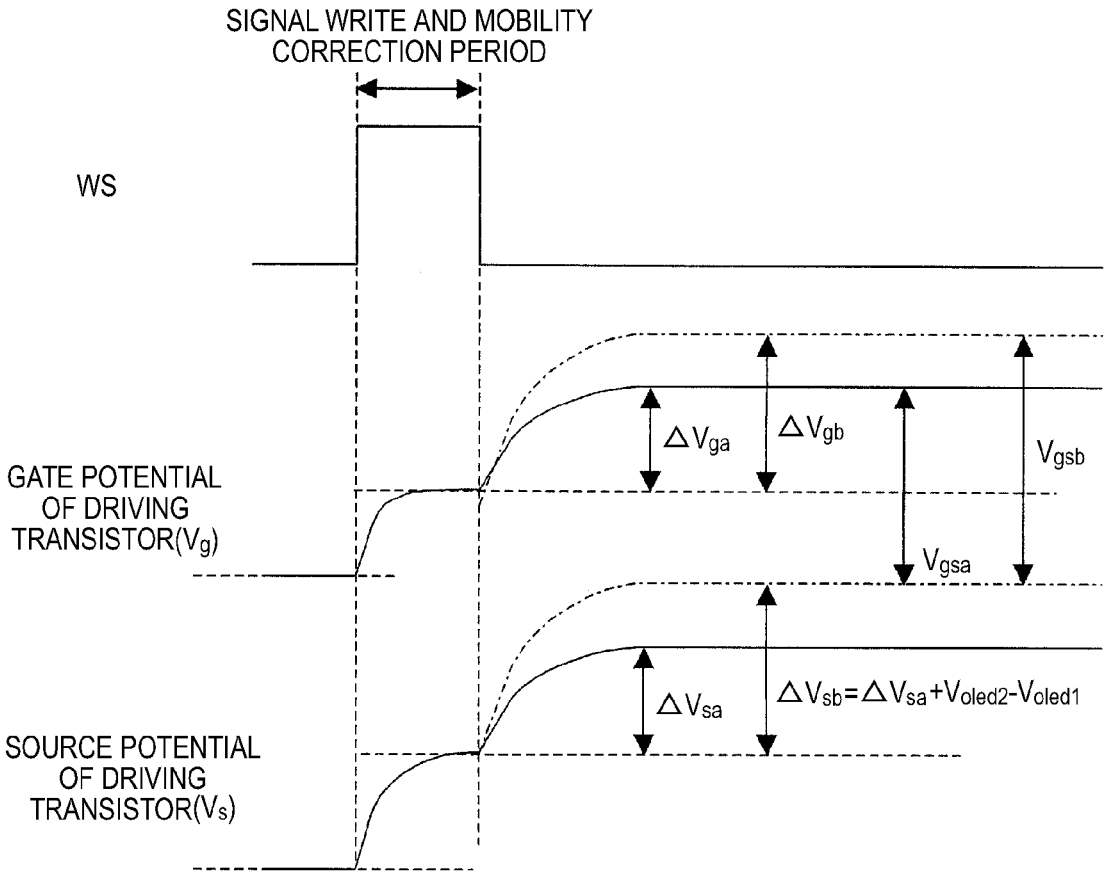
FIG. 14 is a timing waveform diagram illustrating that the current of a driving transistor is decreased by the high-voltage of an organic EL device.

In a pixel where the organic EL device 21 does not deteriorate, the increment amount of the source potential $V_s$ during the bootstrap operation is $\Delta V_{sa}$. By contrast, in a pixel where the organic EL device 21 deteriorates, the increment amount $\Delta V_{sb}$ of the source potential $V_s$ becomes $\Delta V_{sa}+V_{oled2}-V_{oled1}$. Accordingly, the increment amount $\Delta V_g$ of the gate potential $V_g$ is as illustrated in FIG. 14, and the gate-source voltage $V_{gs}$ of the driving transistor 22 is lowered to the extent of $(C_s+C_{gs})/(C_sC_{gs}+C_{gd}+C_{ws})\times(V_{oled2}-V_{oled1})$. As a result, if the parasitic capacitance is high, the decrement amount of the gate-source voltage $V_{gs}$ becomes large. That is, the current $I_{ds}$ of the driving transistor 22 deteriorates to cause burn-in.

(Structure of Write-in Transistor in the Related Art)

Figures 15A, 15B:
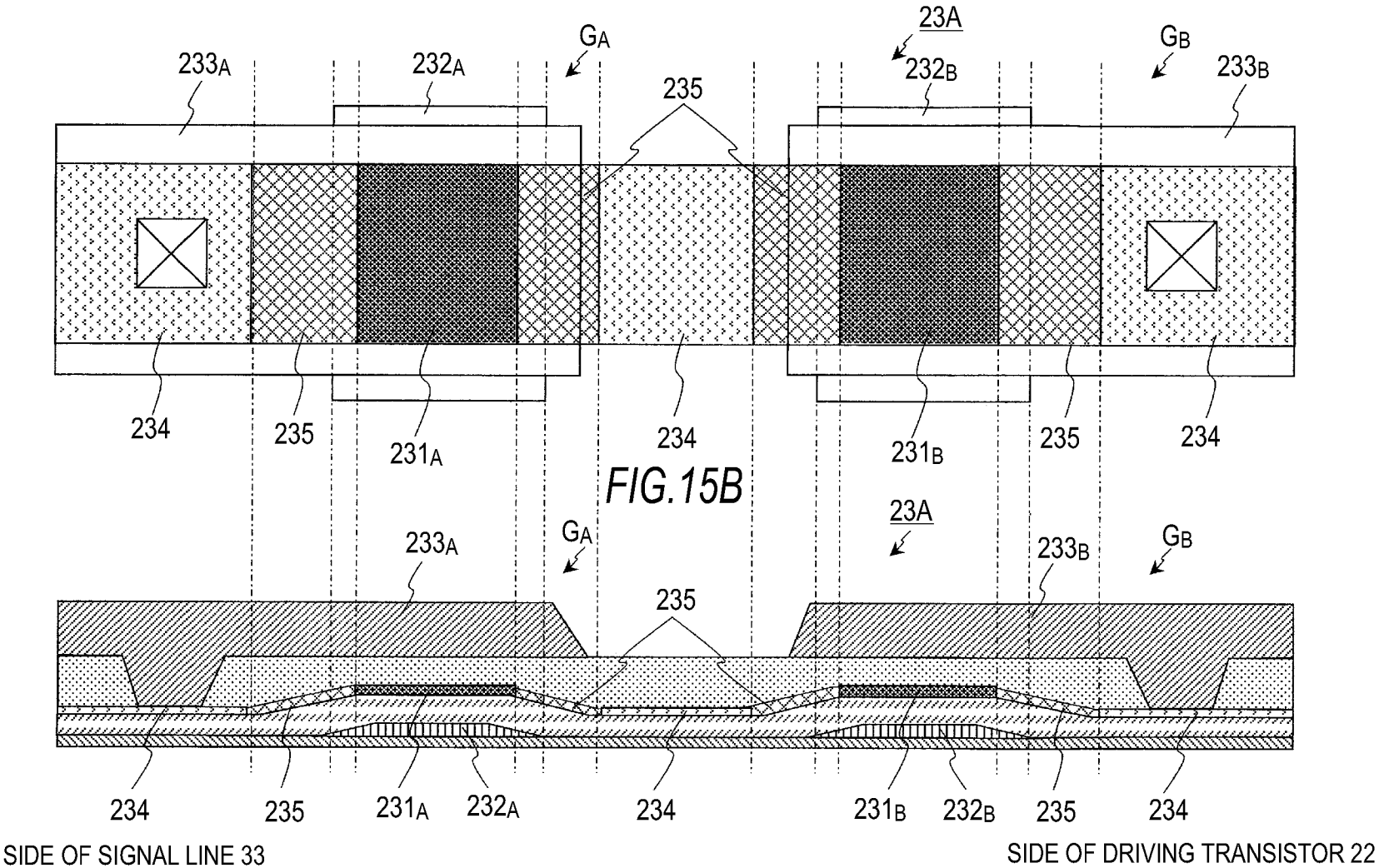

FIGS. 15A and 15B illustrate a general structure of a write-in transistor. FIG. 15A is a plan pattern diagram, and FIG. 15B is a cross-sectional diagram.

The write-in transistor $\mathbf{23}_A$ in the related art has a double gate structure having a plurality of gates, for example, two gates $G_A$ and $G_B$ as a leak prevention measure. The write-in transistor $\mathbf{23}_A$ in the related art also has a shield structure as shield and leak prevention measures for channel regions $\mathbf{231}_A$ and $\mathbf{231}_B$. Specifically, the write-in transistor has a shield structure in which the opposite sides of the gate electrodes $\mathbf{232}_A$ and $\mathbf{232}_B$ of the channel regions $\mathbf{231}_A$ and $\mathbf{231}_B$ are covered by metal wiring layers $\mathbf{233}_A$ and $\mathbf{233}_B$. The write-in transistor $\mathbf{23}_A$ also adopts an LDD (Lightly Doped Drain) structure having a low-density impurity region, that is, an LDD region 235, between the channel regions $\mathbf{231}_A$ and $\mathbf{231}_B$ and the source/drain region 234.

In the write-in transistor $\mathbf{23}_A$ having the above-described configuration in the related art, parasitic capacitances having capacitance values according to the gate width of the gate electrodes $\mathbf{232}_A$ and $\mathbf{232}_B$ are formed between the LDD region 235 and the gate electrodes $\mathbf{232}_A$ and $\mathbf{232}_B$. Also, parasitic capacitance is formed between the metal wiring layers $\mathbf{233}_A$ and $\mathbf{233}_B$ and the channel regions $\mathbf{231}_A$ and $\mathbf{232}_B$. These parasitic capacitances form the parasitic capacitance $C_{ws}$ between the gate and drain of the write-in transistor 23. If the capacitance value of the parasitic capacitance $C_{ws}$ is large, the bootstrap gain $G_b$ deteriorates.

<2. Explanation of Organic El Device According to Embodiments>

The organic EL device according to the embodiment is based on the system configuration as illustrated in FIG. 1, and in the corresponding system configuration, the structure of the write-in transistor constituting a pixel is characterized. Hereinafter, the detailed structure of the write-in transistor $\mathbf{23}_B$ will be described.

The write-in transistor $\mathbf{23}_B$ according to the embodiment has a structure having a plurality of gates, for example, has a double gate structure having two gates. This double gate structure has an advantage that it can reduce leak current between the source region and the drain region.

Also, the write-in transistor $\mathbf{23}_B$ adopts a sandwich structure with respect to the gate on the side of the driving transistor 22 among a plurality of gates. Specifically, the write-in transistor has a sandwich structure in which a second gate electrode that is positioned on the opposite side of a first gate electrode is provided as a back gate electrode with respect to the channel region, and the channel region is sandwiched between the two gate electrodes (first and second gate electrodes). According to this sandwich structure, for example, the transistor characteristic can be improved in comparison to a bottom gate structure.

In the write-in transistor $\mathbf{23}_B$ that adopts a double gate structure and the sandwich structure, the width of the channel region of the gate of the driving transistor side 22 is set to be narrower than the width of the channel region of other gates.

Here, between the second gate electrode that is the back gate electrode and the channel region, parasitic capacitance is formed, which has a capacitance value according to the opposite region between the second gate electrode and the channel region. In this case, in the gate of the driving transistor side 22, the width of the channel region is narrower than the width of the channel region of other gates, and thus the capacitance value of the parasitic capacitance becomes smaller than the capacitance value of the parasitic capacitance formed in other gates.

As described above, the parasitic capacitance that is parasitic on the write-in transistor 23B, particularly, the parasitic capacitance of the gate of the driving transistor side 22, becomes one parameter that determines the bootstrap gain $G_b$. Accordingly, since the capacitance value of the parasitic capacitance can be reduced, the bootstrap gain $G_b$ can be improved and a good quality display image can be obtained without damaging the uniformity of the screen.

In the gate on the side of the driving transistor 22, it is preferable that the gate electrodes are formed so that the width of the second gate electrode is narrower than the width of the first gate electrode on the point of reducing the capacitance value of the parasitic capacitance. Also, on the point of simplifying the manufacturing process, it is preferable to form the second gate electrode with the same wire material as the signal line 33 ($33_{-1}$ to $\mathbf{33}_{-n}$) for transmitting the image signal. On the point of shielding and leak measure, it is preferable to adopt a shield structure in which the channel region is covered by the metal wiring layer even with respect to other gates.

EXAMPLES

Figures 16A, 16B:
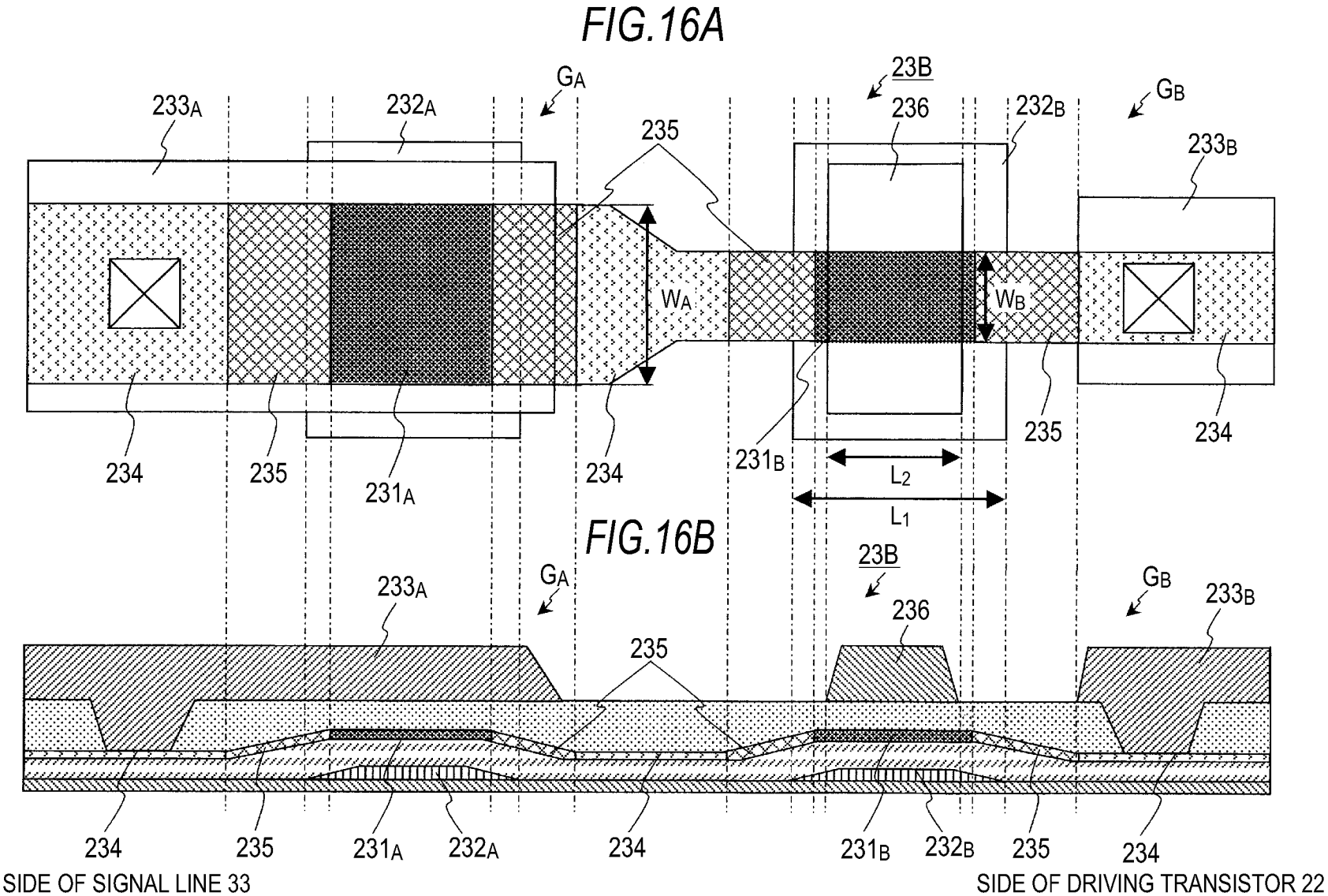

The detailed examples of the write-in transistor $\mathbf{23}_B$ will be described using FIGS. 16A and 16B. FIGS. 16A and 16B are diagrams illustrating the structure of a write-in transistor $\mathbf{23}_B$ according to an example of the invention. FIG. 16A is a plane pattern diagram, and FIG. 16B is a cross-sectional diagram. The same reference numerals are used for the same portions as in FIGS. 15A and 15B.

The write-in transistor $\mathbf{23}_B$ according to the example of the invention, for example, adopts a double gate structure having two gates $G_A$ and $G_B$. By adopting the double gate structure, leak current between the source region (source/drain region 234 on one side) and the drain region (source/drain region 234 on the other side) can be reduced.

Of the two gates $G_A$ and $G_B$, the gate $G_A$ on the side of the signal line 33 adopts a shield structure as a shield and leak prevention measures for the channel region $\mathbf{231}_A$. Specifically, in the gate $G_A$ on the side of the signal line 33, the gate electrode (first gate electrode) $\mathbf{232}_A$ and the metal wiring layer $\mathbf{233}_A$ on the opposite side are formed with respect to the channel region $\mathbf{231}_A$, and the channel region $\mathbf{231}_A$ is shielded by the metal interconnection layer $\mathbf{233}_A$.

Of the two gates $G_A$ and $G_B$, the gate $G_B$ on the side of the driving transistor 22 adopts a shield structure in the same manner as the side of the gate $G_A$ as a shield and leak prevention measures for the channel region $\mathbf{231}_B$. However, on the gate $G_B$ on the side of the driving transistor 22, the second gate electrode 236 is arranged on an opposite side to the first gate electrode $\mathbf{232}_B$ with respect to the channel region $\mathbf{231}_B$, as a back gate electrode.

That is, with respect to the gate $G_B$ on the side of the driving transistor 22, a sandwich gate structure is formed, in which the channel region $\mathbf{231}_B$ is sandwiched between the gate electrode $\mathbf{232}_B$ and two gate electrodes $\mathbf{232}_B$ and 236 of the back gate electrode 236. In the gate $G_B$ having the sandwich gate structure, the back gate electrode 236 functions as a shield member for shielding measures. In forming the back gate electrode 236, on the point of seeking the simplicity of the manufacturing process, it is preferable to form the back gate electrode 236 with the same wiring material as the metal wiring layer such as the signal line 33 ($33_{-1}$ to $\mathbf{33}_{-n}$).

Figure 17:
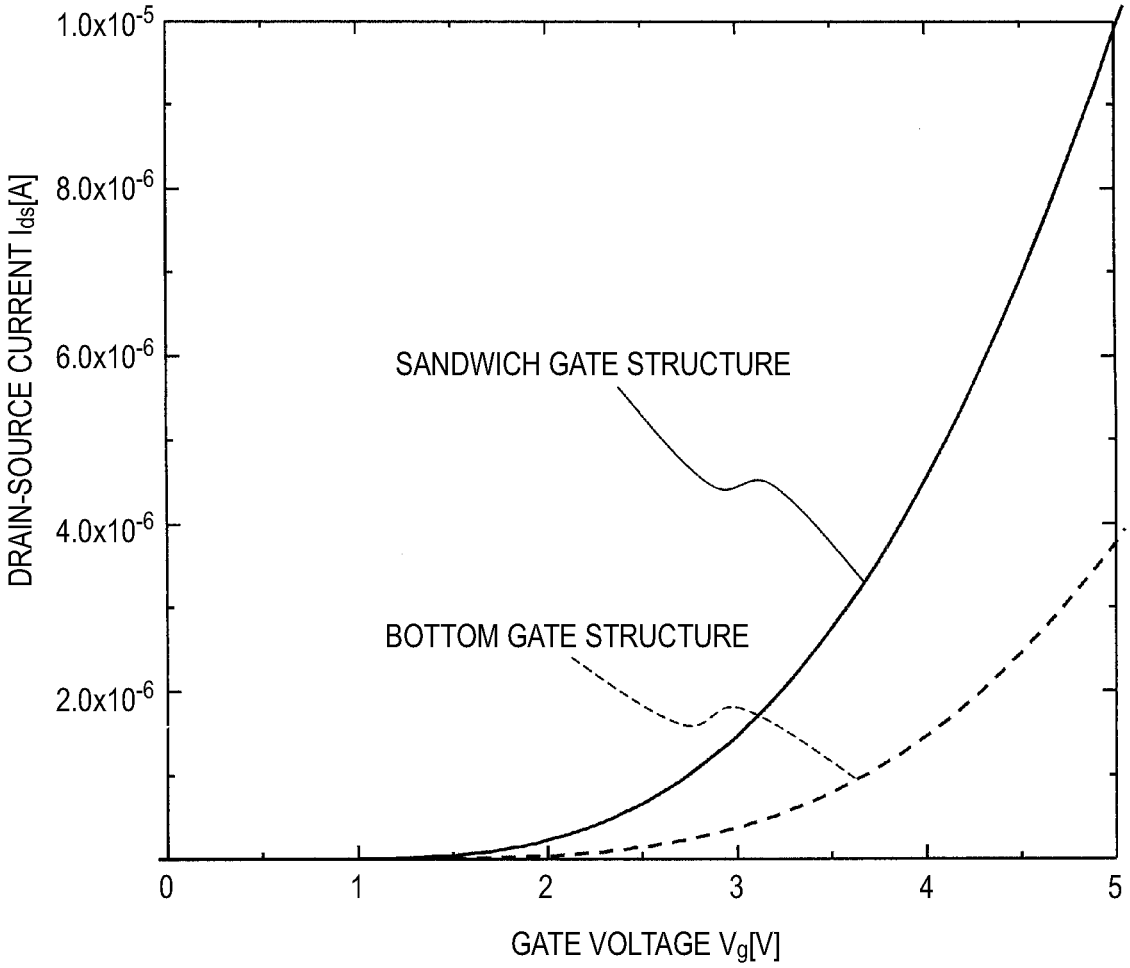
FIG. 17 is a diagram illustrating the relationship between the gate voltage $V_g$ of an N-channel transistor and the drain-source current $I_{ds}$.

FIG. 17 is a diagram illustrating the relationship between the gate voltage $V_g$ of an N-channel transistor and the drain-source current $I_{ds}$. In FIG. 17, a solid line represents the characteristic in the case of the sandwich gate structure, and a dashed line represents the characteristic in the case of a bottom gate structure. As can be known from the drawing, the sandwich gate structure side has a superior characteristic than that of the bottom gate structure. Also, by using the N-channel transistor having the sandwich gate structure as the write-in transistor 23, the improvement of the characteristic of the write-in transistor 23 can be sought.

In the gate $G_B$ of the write-in transistor $\mathbf{23}_B$ adopting the double gate structure and the sandwich gate structure, the width $W_B$ of the channel region $\mathbf{231}_B$ is set to be narrower than the width $W_A$ of the channel region $\mathbf{231}_A$ of other gates $G_A$. Here, between the back gate electrode (second gate electrode) 236 and the channel region $\mathbf{231}_B$, a parasitic capacitance having a capacitance value according to the opposite area between the back gate electrode 236 and the channel region $\mathbf{231}_B$.

In the gate $G_B$ on the side of the driving transistor 22, since the width $W_B$ of the channel region $\mathbf{231}_B$ is narrower than the width $W_A$ of the channel region $\mathbf{231}_A$ of the gate $G_A$, the opposite area can be reduced. Accordingly, the capacitance value of the parasitic capacitance that is formed on the gate $G_B$ can be set to be smaller than the capacitance value of the parasitic capacitance that is formed on the gate $G_A$. Here, on the point of reducing the capacitance value of the parasitic capacitance, it is preferable that the length $L_2$ of the back gate electrode 236 in the channel length direction is shorter than the length $L_1$ of the first gate electrode $\mathbf{232}_B$.

The parasitic capacitance of the gate $G_B$ on the side of the driving transistor 22 becomes one parameter that determines the bootstrap gain $G_b$. Accordingly, since the bootstrap gain $G_b$ can be improved by reducing the capacitance value of the parasitic capacitance of the gate $G_B$, a good quality display image can be obtained without damaging the uniformity of the screen. At this time, although the characteristic of the write-in transistor 23 deteriorates through narrowing of the width $W_B$ of the channel region $\mathbf{231}_B$, the deterioration amount can be covered by adopting the sandwich gate structure, and thus the equivalent transistor characteristic to that of the structure in the related art can be maintained.

Also, since the sandwich gate structure is adopted with respect to the gate GB on the side of the driving transistor 22, the shielding measures for the channel region $\mathbf{231}_B$ can be devised without adopting a dedicated shielding structure. Since the dedicated shielding structure is not adopted, the parasitic capacitance between the gate electrode and the shield (back gate electrode 236) can be eliminated.

Also, the write-in transistor 23 adopts an LDD structure in which an impurity region having a density that is lower than that of the corresponding region 234, that is, an LDD region 235, is installed between the channel regions $\mathbf{231}_A$ and $\mathbf{231}_B$ and the source/drain region 234 so that high electric field is not concentrated onto the region. Especially, in the gate $G_B$ on the side of the driving transistor 22, which adopts the LDD structure, the back gate electrode 236 is formed not to overlap the LDD region 235, and thus the capacitance value of the parasitic capacitance is not increased by the back gate electrode 236. Accordingly, the capacitance value of the parasitic capacitance of the write-in transistor 23 can be further reduced.

<3. Modified Examples>

In the above-described embodiment, it is exemplified that the pixel is configured so that the driving circuit of the organic EL device 21 is basically composed of two transistors including the driving transistor 22 and the write-in transistor 23. However the invention is not limited thereto. That is, the invention can be applied to the whole display devices configured to have a write-in transistor 23 of a structure in which the pixel has a plurality of gates.

Also, in the above-described embodiment, it is exemplified that an organic EL display in which an organic EL device is used as an electro-optical component of the pixel 20 is adopted. However, the invention is not limited to such an application. Specifically, the invention can be applied to the entire display devices that use current driving type electro-optical component (light emitting device) of which the luminance is changed according to the current value flowing through the device, such as an inorganic EL device, an LED device, a semiconductor layer device, and the like.

<4. Applications>

As described above, the display device according to the embodiment of the invention can be applied to display devices of electronic appliances in all fields where an image signal input to the electronic appliance or an image signal generated in the electronic appliance is displayed as an image or a video. As an example, it is possible to apply the invention to display devices of diverse electronic appliances, such as a digital camera, a notebook type personal computer, a portable terminal such as a portable phone, and a video camera.

As described above, by using the display device according to the embodiment of the invention as the display device of electronic appliances in all fields, the picture quality of the display image can be improved in various kinds of electronic appliances. That is, as can be understood from the explanation of the embodiment as described above, since the display device according to the embodiment of the invention can obtain a good-quality display image without damaging the uniformity of the screen by improving the bootstrap gain $G_b$, the picture quality of the display image can be improved in various kinds of electronic appliances.

The display device according to the embodiment of the invention includes a module-shaped device of a sealed configuration. For example, it corresponds to a display module that is formed by attaching an opposite unit such as transparent glass to a pixel array unit 30. In this transparent opposite unit, a color filter, a protection film, and the above-described shielding film may be installed. In this case, a circuit unit for inputting/outputting signals from the outside to the pixel array unit or FPC (Flexible Printed Circuit) may be installed in the display module.

Hereinafter, detailed example of electronic appliances to which the invention is applied will be described.

Figure 18:
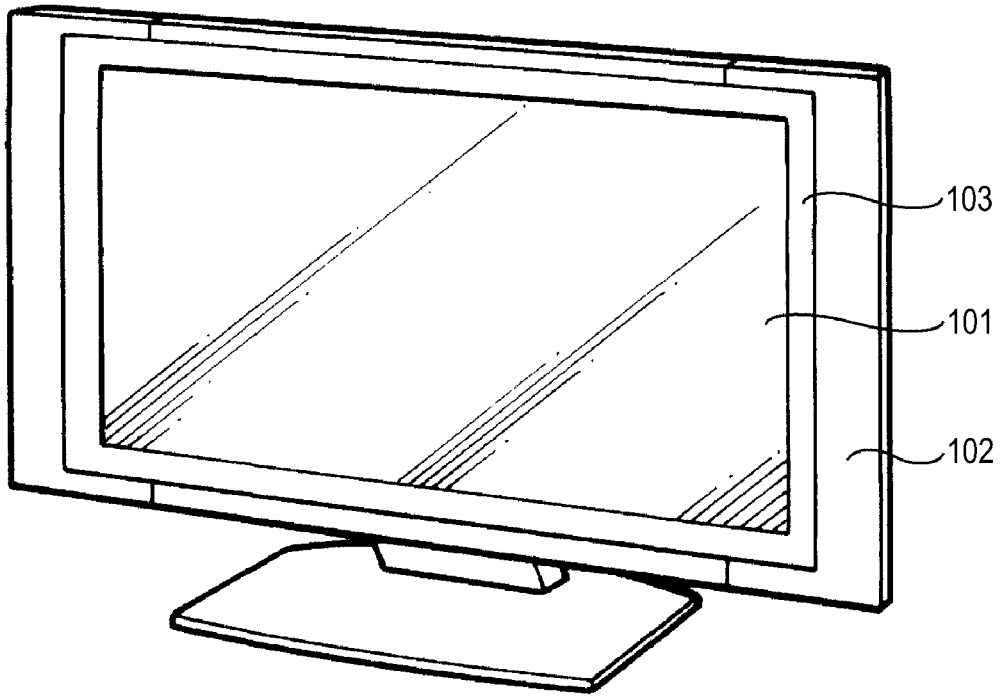
FIG. 18 is a perspective diagram illustrating an external appearance of a television set to which the invention is applied.

FIG. 18 is a perspective diagram illustrating an external appearance of a television set to which the invention is applied. The television set in this application includes an image display screen unit 101 that is composed of a front panel 102 or a filter glass 103, and is manufactured using the display device according to the embodiment of the invention as the image display screen unit 101.

Figure 19A:
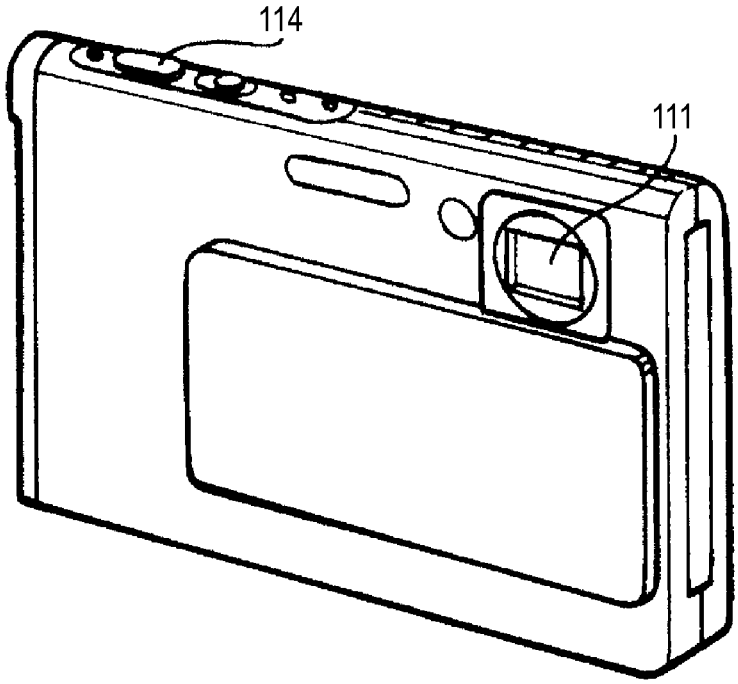
Figure 19B:
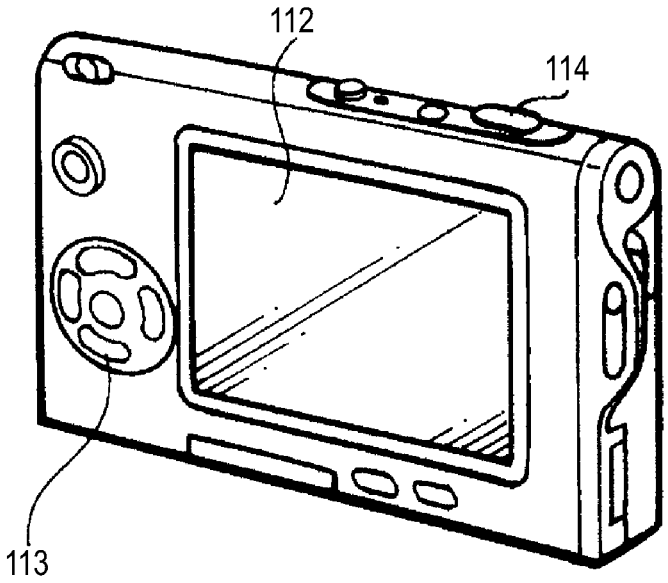

FIGS. 19A and 19B are perspective diagrams illustrating an external appearance of a digital camera to which the invention is applied. FIG. 19A is a perspective diagram as seen from the surface side, and FIG. 19B is a perspective diagram as seen from the rear surface side. The digital camera according to this application includes a light-emitting unit 111 for a flash, a display unit 112, a menu switch 113, a shutter button 114, and the like, and is manufactured using the display device according to the embodiment of the invention as the display unit 112.

Figure 20:
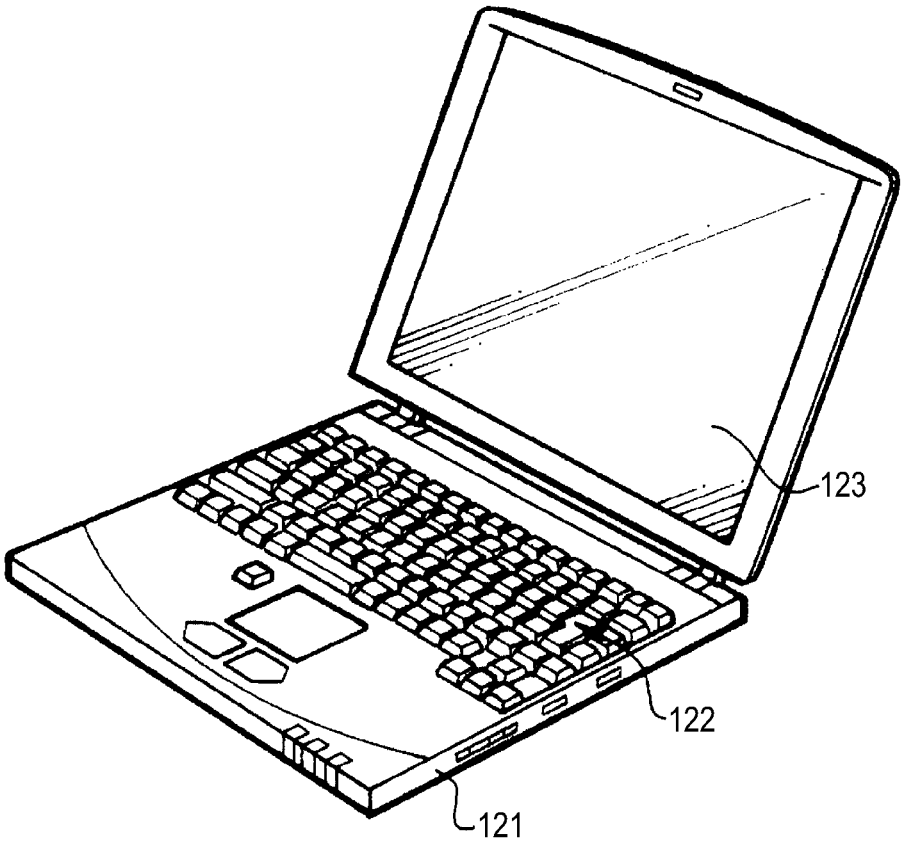
FIG. 20 is a perspective diagram illustrating an external appearance of a notebook type personal computer to which the invention is applied.

FIG. 20 is a perspective diagram illustrating an external appearance of a notebook type personal computer to which the invention is applied. The personal computer according to this application includes a main body 121, a keyboard 122 that is operated when inputting characters and the like, and a display unit 123 for displaying an image, and is manufactured using a display device according to the embodiment of the invention as the display unit 123.

Figure 21:
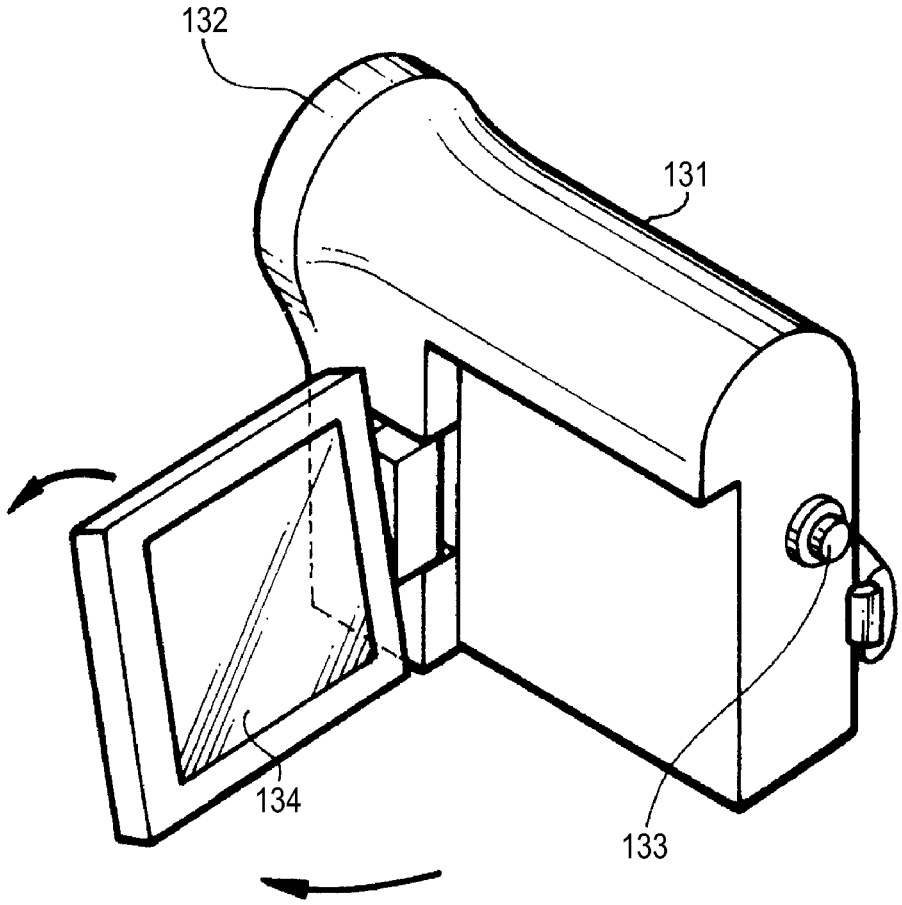
FIG. 21 is a perspective diagram illustrating an external appearance of a video camera to which the invention is applied.

FIG. 21 is a perspective diagram illustrating an external appearance of a video camera to which the invention is applied. The video camera according to this application includes a main body unit 131, a lens 132 provided on a side surface toward the front to capture an image of an object, a start/stop switch 133 used during capturing an image, and a display unit 134, and is manufactured using the display device according to the embodiment of the invention as the display unit 134.

FIGS. 22A to 22G are diagrams illustrating external appearances of a portable terminal, for example, a portable phone, to which the invention is applied. FIG. 22A is a front diagram of a portable phone in an open state, FIG. 22B is a side diagram thereof, FIG. 22C is a front diagram of a portable phone in a closed state, FIG. 22D is a left side diagram thereof, FIG. 22E is a right side diagram thereof, FIG. 22F is a plan diagram thereof, and FIG. 22G is a bottom diagram thereof. The portable phone according to this application includes an upper housing 141, a lower housing 142, a connection unit (here, hinge unit) 143, a display 144, a sub-display 145, a picture light 146, and a camera 147, and is manufacture using the display device according to the embodiment of the invention as the display 144 or the sub-display 145.

The present application contains subject matter related to that disclosed in Japanese Priority Patent Application JP 2010-075059 filed in the Japan Patent Office on Mar. 29, 2010, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising a plurality of arranged pixels, each of which includes an electro-optical component, a write-in transistor for writing an image signal into the pixel, a maintenance capacity element for maintaining the image signal written by the write-in transistor, and a driving transistor for driving the electro-optical component based on the image signal maintained by the maintenance capacity element, wherein, the write-in transistor has a plurality of gates, a driving transistor side gate from among the plurality of gates has a structure in which a channel region is sandwiched between a first gate electrode and a second gate electrode, the width of the channel region of the driving transistor side gate is narrower than the width of the channel region of each of the other gates, and except for the driving transistor side gate, the gates are shielded by a metal wiring layer.

2. The display device according to claim 1, wherein the second gate electrode has a width that is narrower than a width of the first gate electrode.

3. The display device according to claim 1, wherein the second gate electrode is formed of the same wiring material as a signal line for transmitting the image signal.

4. The display device according to claim 1, wherein the write-in transistor has an LDD structure in which an impurity region having a density that is lower than that of a source/drain region is provided between the source/drain region and a channel region.

5. The display device according to claim 4, wherein the second gate electrode does not overlap the impurity region.

6. The display device according to claim 1, wherein, in the write-in transistor, a parasitic capacitance exists between the channel region and the second gate electrode, and the capacitance value of the parasitic capacitance is one parameter that determines a gain during a bootstrap operation in which a gate potential of the driving transistor is changed to follow a source potential of the driving transistor when the write-in transistor is in a non-conductive state.

7. The display device according to claim 6, wherein the source potential of the driving transistor is changed according to a current flowing through the driving transistor.

8. An electronic appliance comprising: a display device including a plurality of arranged pixels, each of which includes an electro-optical component, a write-in transistor for writing an image signal into the pixel, a maintenance capacity element for maintaining the image signal written by the write-in transistor, and a driving transistor for driving the electro-optical component based on the image signal maintained by the maintenance capacity element, wherein, the write-in transistor has a plurality of gates, the driving transistor-side gate from among the plurality of gates has a structure in which a channel region is sandwiched between a first gate electrode and a second gate electrode, and a width of the channel region of the driving transistor-side gate is narrower than a width of the channel region of each of the other gates, and except for the driving transistor-side gate, the plurality of gates are shielded by a metal wiring layer.

* * * * *